US010473372B2

(12) United States Patent
Chen et al.

(10) Patent No.: US 10,473,372 B2
(45) **Date of Patent: *Nov. 12, 2019**

(54) SYSTEM AND METHOD FOR CHARGING A REFRIGERATION SYSTEM

(71) Applicant: Nortek Global HVAC LLC, O'Fallon, MO (US)

(72) Inventors: Jie Chen, Saint Charles, MO (US); Jan Pottinger, O'Fallon, MO (US)

(73) Assignee: Nortek Global HVAC, LLC, O'Fallon, MO (US)

( * ) Notice: Subject to any disclaimer, the term of this patent is extended or adjusted under 35 U.S.C. 154(b) by 97 days.

This patent is subject to a terminal disclaimer.

(21) Appl. No.: 15/348,659

(22) Filed: Nov. 10, 2016

(65) Prior Publication Data

US 2018/0128529 A1 May 10, 2018

(51) Int. Cl.
*F25B 45/00* (2006.01)
*F25B 49/02* (2006.01)

(52) U.S. Cl.
CPC ..... *F25B 45/00* (2013.01); *F25B 49/02* (2013.01); *F25B 2345/001* (2013.01); *F25B 2500/19* (2013.01); *F25B 2500/24* (2013.01); *F25B 2600/01* (2013.01); *F25B 2600/2513* (2013.01); *F25B 2700/195* (2013.01); *F25B 2700/197* (2013.01); *F25B 2700/21161* (2013.01); *F25B 2700/21163* (2013.01); *F25B 2700/21171* (2013.01); *F25B 2700/21175* (2013.01)

(58) Field of Classification Search
CPC ..... F25B 2500/19; F25B 2700/197; F25B 2700/21163; F25B 2700/21175
See application file for complete search history.

(56) References Cited

U.S. PATENT DOCUMENTS 6,571,566 B1 6/2003 Temple et al.
7,631,508 B2 12/2009 Braun et al.
7,905,095 B2 * 3/2011 Suharno ..... B60H 1/00585 62/149
2018/0128528 A1 5/2018 Chen et al.

OTHER PUBLICATIONS

"3.8 Evaluating Refrigerant Charge", Weatherization Field Guide. (c) 2005, Energy Outwest and Saturn Resource Management, Inc., (2005), 6 pgs.

(Continued)

*Primary Examiner* — Filip Zec
(74) *Attorney, Agent, or Firm* — Schwegman Lundberg & Woessner, P.A.

(57) ABSTRACT

A method for charging a field refrigeration system including an evaporator, a condenser, a compressor, and an expansion device includes calculating a field subcooling of the field refrigeration system as a function of a measured field liquid line pressure and a measured field liquid line temperature. A charge adjustment percentage can be calculated as a function of the field subcooling, a measured field indoor wet bulb temperature, and a measured field outdoor dry bulb temperature. A refrigerant adjustment weight can be determined based on the charge adjustment percentage. A field refrigeration system charge can be adjusted by the refrigerant adjustment weight.

20 Claims, 20 Drawing Sheets

(56) References Cited

OTHER PUBLICATIONS

Temple, Keith A., et al., "A Performance Based Method to Determine Refrigerant Charge Level in Unitary Air Conditioning and Heat Pump Systems", Purdue e-Pubs, International Refrigeration and Air Conditioning Conference at Purdue, Jul. 12-15, 2004, (2004), 8 pgs.
"U.S. Appl. No. 15/348,571, Response filed Aug. 6, 2018 to Restriction Requirment dated Jun. 4, 2018", 10 pgs.
"U.S. Appl. No. 15/348,571, Restriction Requirement dated Jun. 4, 2018", 7 pgs.
"U.S. Appl. No. 15/348,571, Non Final Office Action dated Dec. 3, 2018", 7 pgs.

* cited by examiner

SYSTEM AND METHOD FOR CHARGING A REFRIGERATION SYSTEM

COPYRIGHT NOTICE

A portion of the disclosure of this patent document contains material that is subject to copyright protection. The copyright owner has no objection to the facsimile reproduction by anyone of the patent document or the patent disclosure, as it appears in the Patent and Trademark Office patent files or records, but otherwise reserves all copyright rights whatsoever. The following notice applies to the software and data as described below and in the drawings that form a part of this document: Copyright Nortek Global HVAC, LLC, 2016. All Rights Reserved.

TECHNICAL FIELD

This document pertains generally, but not by way of limitation, to refrigeration cooling systems, and, more particularly, this document relates to refrigerant charge control in refrigeration cooling systems.

BACKGROUND

Heating, ventilation, and cooling (HVAC) systems often employ refrigeration systems to transfer heat for the purposes of heating or cooling a space or volume of fluid. Refrigeration systems are typically closed circulating fluid systems that use refrigerants, such as R-134a, R-410A, or R-407C, as a medium or working fluid for heat transfer processes. Most refrigerants operate efficiently in a given range of working pressures, where the range depends on the operating conditions of a system, such as a system's operating temperature range.

OVERVIEW

To operate a system near or within its optimal pressure range, the amount of refrigerant, or charge, within the system should be carefully controlled. An incorrect refrigerant charge in an air conditioning system can degrade a system's performance, such as cooling capacity and efficiency, and can also cause reliability issues. These issues can be amplified in refrigeration systems using microchannel heat exchangers. Microchannel heat exchangers require less refrigerant charge than traditional tube heat exchangers, making their systems more sensitive to the amount of refrigerant charge.

Systems and methods of the present disclosure address the above-mentioned issues by providing a refrigerant charge method for refrigeration systems. The present inventors have recognized, among other things, that a problem to be solved in charging refrigeration systems can include calculating an ideal charge and charge adjustment volume, while minimizing refrigerant recovery. In an example, the present subject matter can provide a solution to this problem, such as by testing a test system to develop a charge percentage map, which can then be used to correlate field system information and conditions to determine a charge percentage and/or a charge adjustment percentage for the field system.

A refrigeration system comprises a compressor, at least one expansion valve, a condenser, an evaporator, pressure and temperature sensor, and a controller. The controller can be configured to determine, among other things, a charge percentage and/or a charge adjustment percentage for a field refrigeration system as well as a charge adjustment weight.

This overview is intended to provide an overview of subject matter of the present patent application and is provided only by way of example, and not limitation. It is not intended to provide an exclusive or exhaustive explanation of the invention. Other aspects of the present invention will be appreciated in view of the entirety of the present disclosure, including the entire text, claims and accompanying figures.

BRIEF DESCRIPTION OF THE DRAWINGS

In the drawings, which are not necessarily drawn to scale, like numerals may describe similar components in different views. Like numerals having different letter suffixes may represent different instances of similar components.

Figure 1A:
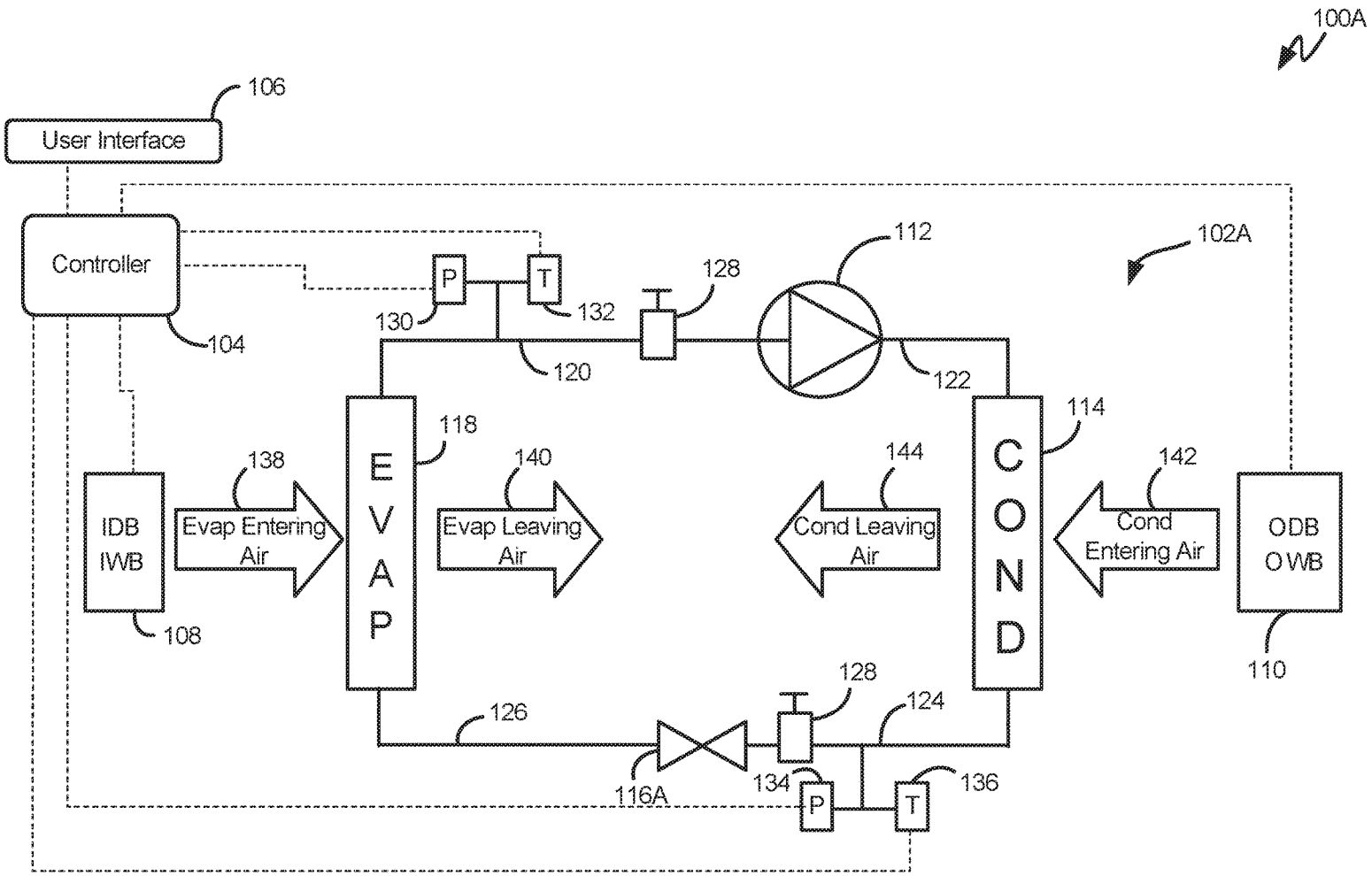
FIG. 1A illustrates a schematic view of an example refrigeration system.

This disclosure presents the invention by way of representation and not limitation. While the above-identified figures set forth embodiments of the present invention, other embodiments are also contemplated, as noted in the discussion. It should be understood that other modifications and examples that fall within the scope and spirit of the principles of the invention can be devised by those skilled in the art. The figures may not be drawn to scale, and applications and embodiments of the present invention may include features, steps and/or components not specifically shown in the drawings.

DETAILED DESCRIPTION

This detailed description includes references to the accompanying drawings, which form a part of the detailed description. The drawings show, by way of illustration, specific embodiments in which the invention can be practiced. These embodiments are also referred to herein as "examples." Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

This document discusses several examples where superheat and subcooling can be calculated for a refrigeration system. Superheat is a value that represents an amount that a working fluid has been heated above an evaporation temperature of the working fluid. Superheat is equivalent to the difference between the evaporation temperature (Te) and suction temperature (Ts). A superheat can be calculated using two measured values, suction pressure (Ps) and suction temperature (Ts). First, the suction pressure can be converted to an evaporation temperature for the given working fluid (such as R410A, for example). Next, the evaporation temperature (Te) is subtracted from the suction temperature (Ts), as shown in equations 1 below:

$$Ts-Te=S \qquad \text{Equation 1}$$

Subcooling is a value that represents how much a working fluid has been cooled below a condensing temperature of the working fluid. Subcooling (SC) is equivalent to the difference between a condensing temperature (Tc) and a liquid temperature ($T_L$). A subcooling can be calculated using two measured values, liquid line pressure ($P_L$) and liquid line temperature ($T_L$). First, the liquid line pressure can be converted to a condensing temperature for the given working fluid (such as R410A, for example). Next, the liquid line temperature ($T_L$) is subtracted from the condensing temperature (Tc), as shown in equations 2 below:

$$Tc-T_L=SC \qquad \text{Equation 2}$$

FIG. 1A illustrates a schematic view of refrigeration system 100A, which can include refrigeration circuit 102A, controller 104, user interface 106, an indoor air zone 108, and an outdoor air zone 110. Refrigeration circuit 102A can include compressor 112, condenser 114, expansion device 116A, evaporator 118, suction line 120, discharge line 122, liquid line 124, distributor line 126, charging port 128, suction pressure sensor 130, suction temperature sensor 132, liquid pressure sensor 134, and liquid temperature sensor 136. Indoor air zone 108 can include evaporator entering air 138 and evaporator leaving air 140. Outdoor air zone 110 can include condenser entering air 142 and condenser leaving air 144. Also shown in dashed lines are communication paths to and from controller 104. The communication paths can be wired links, wireless links, or other communication mediums.

Refrigeration circuit 102A can be connected consistently with refrigerant based vapor compression cycle systems, as are known in the art. Generally, refrigeration circuit 102A can be connected as follows: compressor 112 can be connected to condenser 114 by discharge line 112; condenser 114 can be connected to expansion device 116A by liquid line 124; expansion device 116A can be connected to evaporator 118 by distributor line 126; and, evaporator 118 can be connected to compressor 112 by suction line 120.

Suction line 120, discharge line 122, liquid line 124, and distributor line 126 can be tubes, pipes, conduits, and the like, that are capable of conveying refrigerant through refrigeration circuit 102A within the operating pressures and temperatures regularly seen in refrigeration systems.

Suction pressure sensor 130 and suction temperature sensor 132 can be connected to suction line 120 and exposed to the refrigerant within suction line 120. Suction pressure sensor 130 and suction temperature sensor 132 can also be connected to controller 104. Liquid pressure sensor 134 and liquid temperature sensor 136 can be connected to liquid line 124 and exposed to the refrigerant within liquid line 124. Liquid pressure sensor 134 and liquid temperature sensor 136 can also be connected to controller 104.

Suction pressure sensor 130 and liquid pressure sensor 134 can be microelectromechanical (MEM) transducers, capacitive sensors, piezoresistive sensors, and the like, configured to produce and transmit a signal as a function of pressure. Suction temperature sensor 132 and liquid temperature sensor 136 can be a thermistor, a thermocouple, a resistance temperature detector (RTD), and the like, configured to produce and transmit a signal as a function of temperatures. Charging port 128 can be a Schrader valve, a pin valve, and the like, configured to allow refrigerant to be added to and removed from refrigeration circuit 102A. Charging port 128 can be located in suction line 120 and liquid line 124.

Compressor 112 can be a positive displacement refrigerant compressor, such as a scroll compressor, a reciprocating compressor, a rotary compressor, and the like. Compressor 112 can be configured to pump a refrigerant such as R-134a, R-410A, R-407C, and the like. Evaporator 118 and condenser 114 can be coils configured to exchange heat between refrigerant and air, such as tube and fin coils, microchannel coils, and the like. Expansion device 116A can be a fixed orifice expansion device, such as a capillary tube, metering piston, and the like, configured to expand a liquid refrigerant.

Controller 104 can be a direct digital controller (DDC), a programmable logic controller (PLC), a personal computer, a remote server, and the like, configured to receive inputs from the components of refrigeration circuit 102A, perform calculations, and manage refrigeration circuit 102A. Controller 104 can be connected to user interface 106, which can be a keypad and display, a touch screen, combination of mouse, keyboard, and monitor, and the like.

Indoor air zone 108 and an outdoor air zone 110 can be zones including large volumes of air and including dry bulb and wet bulb temperature sensors that can be connected to controller 104. In some examples, indoor air zone 108 can include a volume of air within a house, school, office, and the like. In some examples, outdoor air zone 110 can include a volume of air in an ambient environment, or in an environment external to indoor air zone 108, typically having a much larger volume of air than indoor air zone 108. Indoor air zone 108 can have properties such as an indoor dry bulb temperature and an indoor wet bulb temperature. Outdoor air zone 110 can have properties such as an outdoor dry bulb temperature and an outdoor wet bulb temperature.

In operation of some examples shown in FIG. 1A, compressor 112 can pump refrigerant through refrigeration circuit 102A. The refrigerant can be cooled and condensed by outdoor air. Outdoor air can enter condenser 114 as condenser entering air and can be heated by refrigerant within condenser 114 in a heat exchange process and exits condenser 114 as condenser leaving air 144. The cooled and condensed refrigerant can be delivered to expansion device 116A, which can expand liquid refrigerant at a fixed rate into a low temperature low pressure liquid and gas mixture for evaporator 118. Evaporator 118 can cool indoor air, which enters evaporator 118 as evaporator entering air 138, can be cooled in a heat exchange with the refrigerant through evaporator 118, and leaves evaporator 118 as evaporator leaving air 140.

Figure 1B:
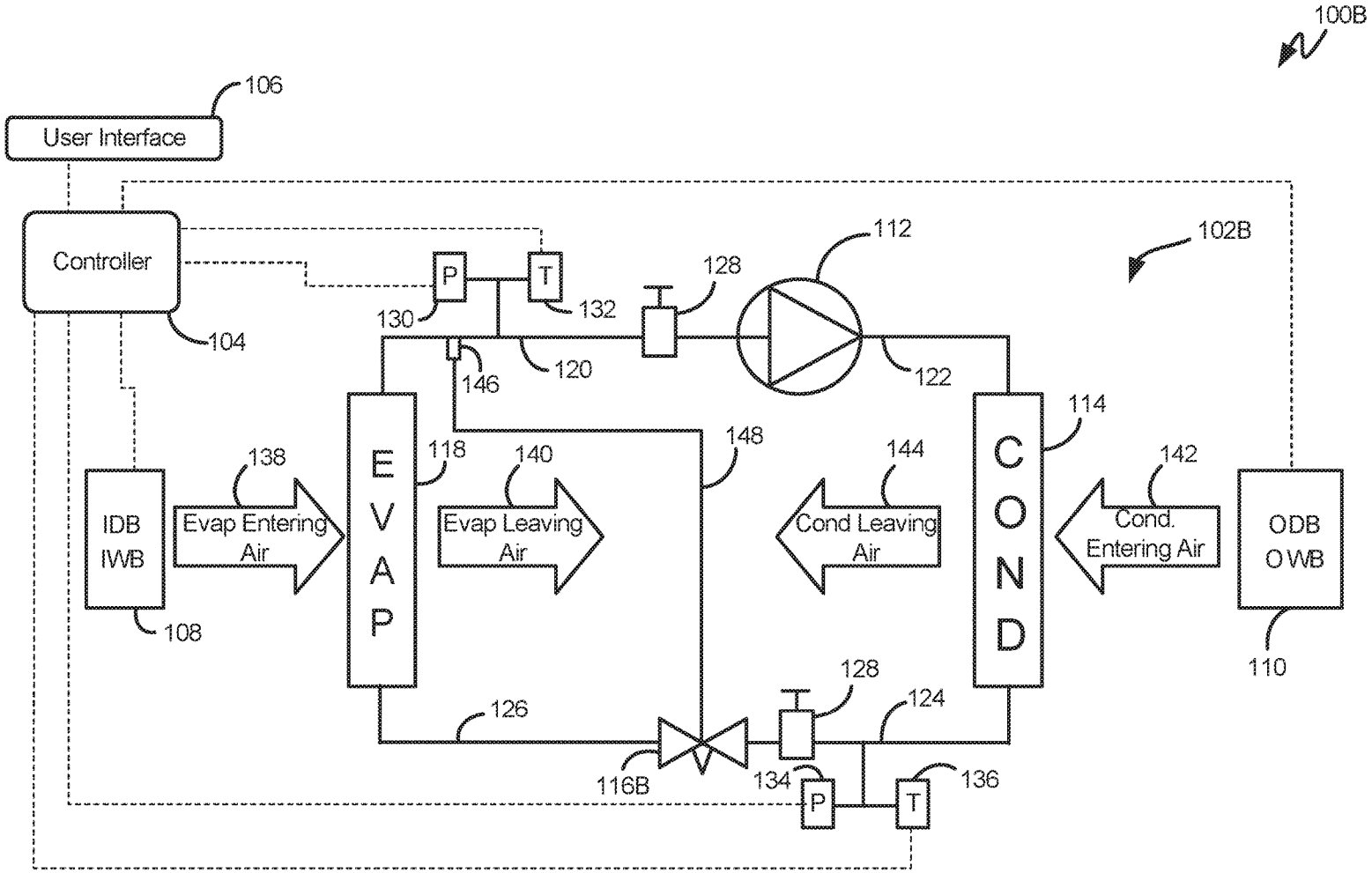
FIG. 1B illustrates a schematic view of another example refrigeration system, in accordance with at least one example of this disclosure.

FIG. 1B illustrates a schematic view of refrigeration system 100B, which can include refrigeration circuit 102B, controller 104, user interface 106, an indoor air zone 108, and an outdoor air zone 110. Refrigeration circuit 102B can include compressor 112, condenser 114, expansion device 116B, evaporator 118, suction line 120, discharge line 122, liquid line 124, distributor line 126, charging port 128, suction pressure sensor 130, suction temperature sensor 132, liquid pressure sensor 134, and liquid temperature sensor 136. Indoor air zone 108 can include evaporator entering air 138 and evaporator leaving air 140. Outdoor air zone 110 can include condenser entering air 142 and condenser leaving air 144. Expansion device 116B can include sensing bulb 146 and capillary tube 148. Also shown in dashed lines are communication paths to and from controller 104. The communication paths can be wired links, wireless links, or other communication mediums.

Refrigeration system 100B can be connected consistently with refrigeration system 100A. However, refrigeration system 100B can differ, in that it can include expansion device 116B, which can be, in some examples, a thermal expansion valve (TXV). Expansion device 116B can be connected to evaporator 118 by distributor line 126 and can be connected to condenser 114 by liquid line 124. Expansion device 116B can also be connected to sensing bulb 146 by capillary tube 148. Sensing bulb 146 can be externally connected to suction line 120.

Figure 1C:
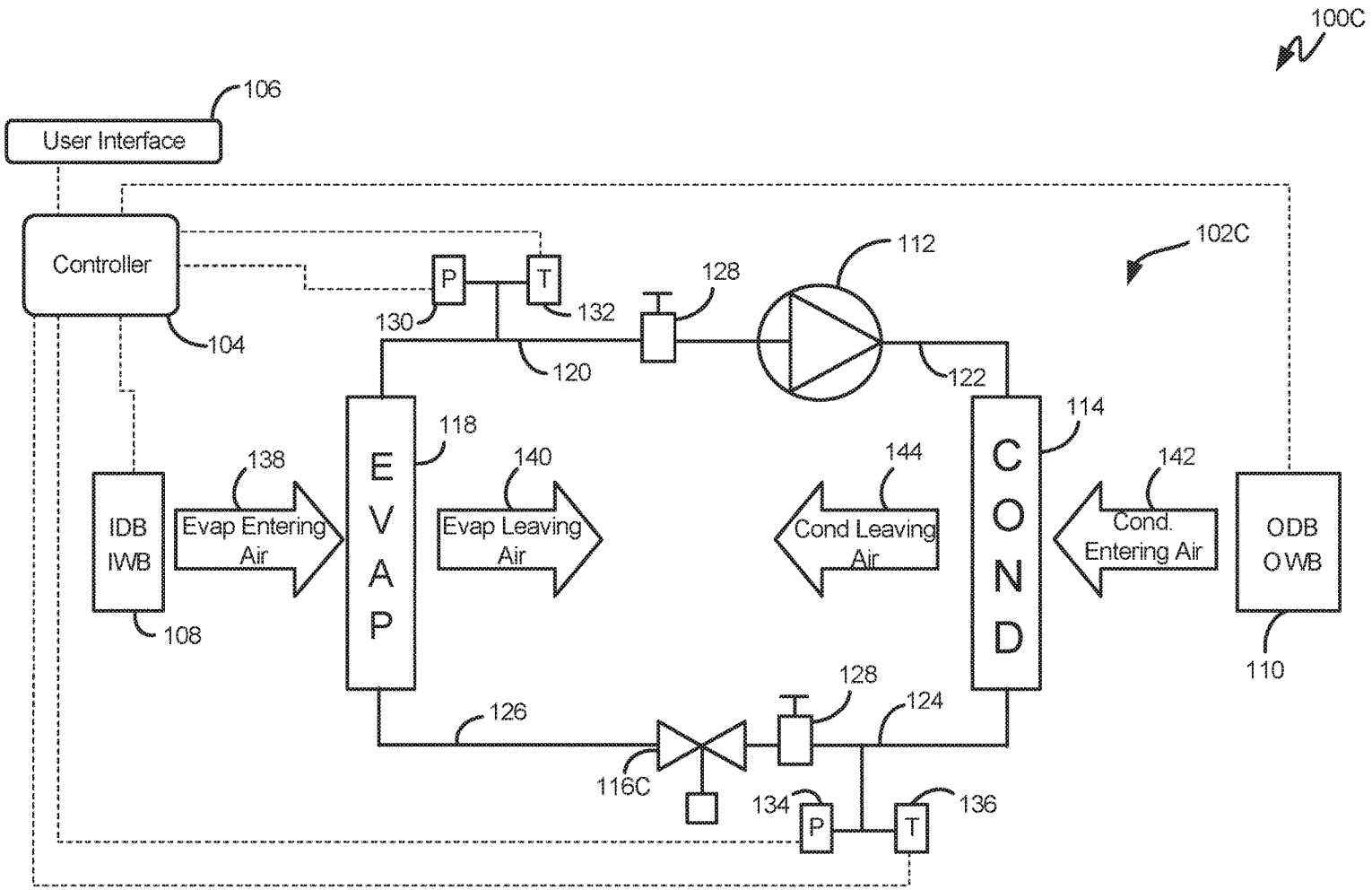
FIG. 1C illustrates a schematic view of another example refrigeration system, in accordance with at least one example of this disclosure.

Refrigeration circuit 102B can operate consistently with refrigeration circuit 102A, except that expansion device 112B can sense the temperature of suction line 120 through sensing bulb 146. Sensing bulb 146 can convert the sensed temperature into a pressure and transmit the pressure through capillary tube 148 to expansion device 116B. Using this pressure, expansion device 116B can be configured to control the flow of refrigerant through expansion device 116B as a function of the temperature of the suction line, controlling the flow of refrigerant through evaporator 114 as a function of the suction line temperature, in some examples. Using an expansion device in this manner is known as superheat control FIG. 1C illustrates a schematic view of refrigeration system 100C which can include refrigeration circuit 102C, controller 104, user interface 106, an indoor air zone 108, and an outdoor air zone 110. Refrigeration circuit 102C can include compressor 112, condenser 114, expansion device 116C, evaporator 118, suction line 120, discharge line 122, liquid line 124, distributor line 126, charging port 128, suction pressure sensor 130, suction temperature sensor 132, liquid line pressure sensor 134, and liquid temperature sensor 136. Indoor air zone 108 can include evaporator entering air 138 and evaporator leaving air 140. Outdoor air zone 110 can include condenser entering air 142 and condenser leaving air 144. Also shown in dashed lines are communication paths to and from controller 104. The communication paths can be wired links, wireless links, or other communication mediums.

Refrigeration system 100C can be connected consistently with refrigeration system 100B. However, refrigeration system 100C can differ in that it can include expansion device 116C, which can be, in some examples, an electronic expansion valve (EEV). Expansion device 116C can be connected to evaporator 118 by distributor line 126 and can be connected to condenser 114 by liquid line 124. Expansion device 116C can also be connected a controller.

Refrigeration circuit 102C can operate consistently with refrigeration circuit 102B, except that expansion device 112C can be controlled by controller 104. Controller 104 can receive suction pressure and suction temperature signals from suction pressure sensor 130 and suction temperature sensor 132, respectively. A controller, such as a DDC, a PLC, and the like, can then send control signals to expansion device 116C as a function of the suction pressure and suction temperature signals, controlling expansion device 116C to the pressure and temperature of the refrigerant in suction line 120.

Each of refrigeration systems 102A, 102B, and 102C can be refrigeration systems in a field, as explained above, or can be test refrigeration systems, such as a laboratory test refrigeration system used for data collection and analysis, as described below.

To operate effectively and efficiently, refrigeration circuits 102A, 102B, and 102C should be charged to an appropriate volume of refrigerant. To operate refrigeration circuits 102A, 102B, and 102C near or within its optimal pressure range, the amount of refrigerant, or charge, within refrigeration circuit 102 should be carefully controlled. The following disclosure teaches methods for charging and adjusting a charge of a refrigeration system.

Figure 2:
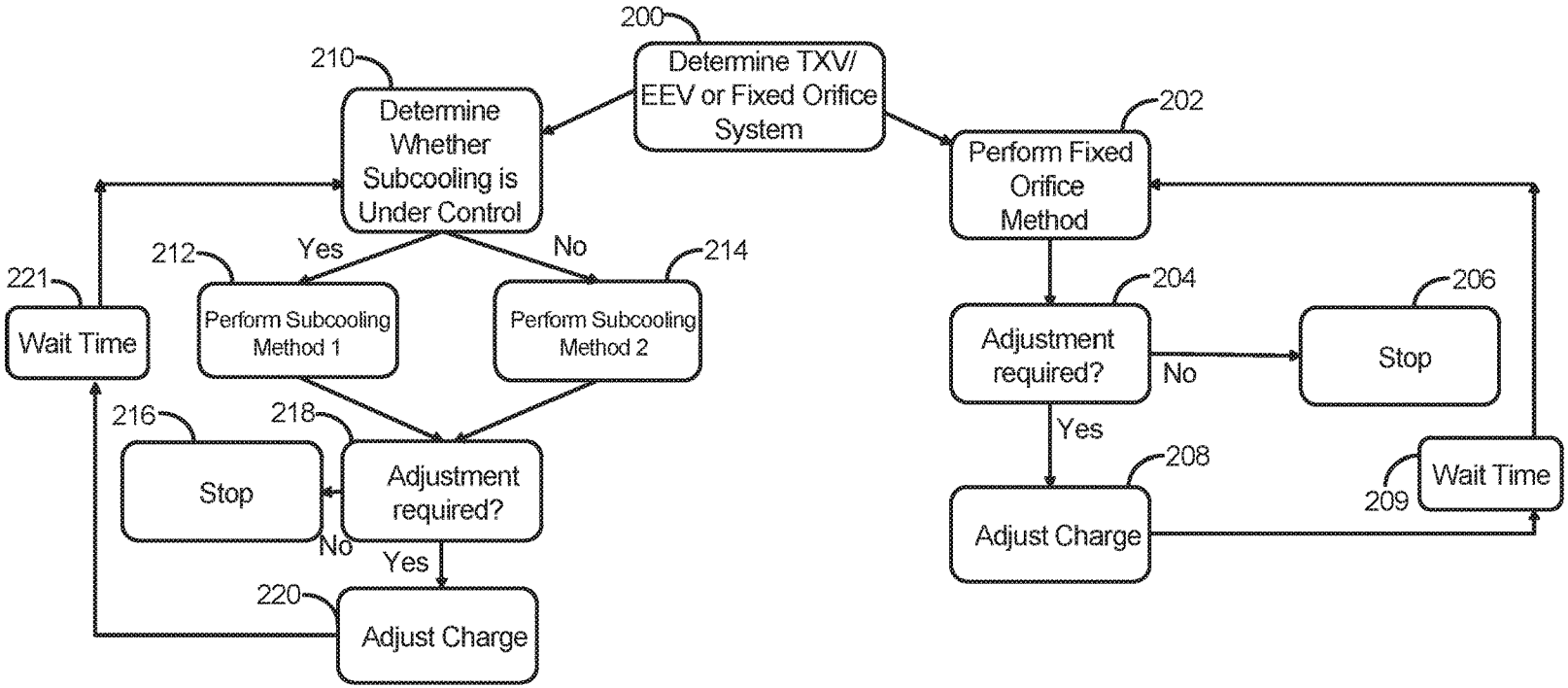
FIG. 2 illustrates a flow diagram of an example method of charging the refrigeration system of FIG. 1.

FIG. 2 illustrates a flow diagram of an example method of charging refrigeration systems 100A, 100B, and 100C.

Refrigeration systems 100A, 100B, and 100C can be charged with an initial amount of refrigerant and then operated. During operation of refrigeration systems 100A, 100B, and 100C, a current refrigeration charge can be determined, an adjustment can be determined, and a charge can be added to refrigeration systems 100A, 100B, or 100C. Various methods to determine an existing charge and a charge adjustment can be performed based on the refrigeration system type, as shown in FIG. 2.

At step 200, the type of expansion device, a fixed orifice or a TXV, can be determined. In some examples, an EEV can be used as an expansion device. In these examples, the method for T×V systems may be used for EEV systems. If the expansion device is a fixed orifice, the step perform fixed orifice method 202 can be performed. At step 204, it can be determined whether or not an adjustment to the charge of the refrigeration system is required. If a charge adjustment is not required, step 206 can be performed, which can be to stop the method, because the charge is correct. If a charge adjustment is required, step 208 can be performed, where the charge of the refrigeration system can be adjusted. After the charge is adjusted at step 208, wait time can be performed at step 209, where a time must be waited before step 202 can be performed again. The time elapsed can be determined as a function of the amount of charge added to the refrigeration system and/or as a function of an estimated total charge volume of the refrigeration system. In some examples, the amount of time waited at step 209 can be determined based on a linear correlation between an amount of refrigerant added and wait time. In some examples, controller 104 can wait to output a charge adjustment value for the charge to be adjusted at either step 208 or 202 based on elapsed time between iterations of steps 208 or 202.

If the expansion device is a TXV, step 210 can performed, where it can be determined whether the TXV is under control. A TXV or EEV can be considered to be not under control when the refrigerant entering the TXV or EEV has a subcooling that is relatively low. A low subcooling can cause the expansion port of the TXV or EEV to open fully to create desired expansion of the refrigerant. When the expansion port is fully open, the TXV or EEV cannot control the refrigerant as a function of superheat. In other words, the valve cannot control the superheat of the refrigerant as it exits the evaporator. That is, the valve is not under superheat control. Conversely, when a valve is effectively controlling refrigerant flow and expansion as a function of sensed superheat, a TXV or EEV is said to be under control. In practice, 5° Fahrenheit (2.8° Celsius) can be a good indication of whether the valve is under control, but other subcooling temperatures can be used, as described below. This can be referred to as the valve being under control, the TXV or EEV being under control, the superheat being under control, or the subcooling being under control.

In some examples, when the TXV or EEV is not under control, a method based on subcooling cannot be used, because the subcooling reading is not reliable. In these examples, when the TXV or EEV is not under control, a superheat based method should be used. In some other examples, when the TXV or EEV is under control, a subcooling based method can be used, because the subcooling can be a more accurate indication of system operation when it is known that the superheat is under control.

When the TXV is under control, a first method can be performed at step 212. When the TXV is not under control, a second method can be performed at step 214. After either steps 212 or 214 are performed, it can be determined whether an adjustment to the charge of the refrigeration system is required at step 218. If a charge adjustment is not required, step 216 can be performed, which can be to stop the method, because the charge is correct. If a charge adjustment is required, step 220 can be performed, where the charge of the refrigeration system can be adjusted.

After the charge is adjusted at step 220, wait time can be performed at step 221, where a time must be waited before step 210 can be performed again. The time elapsed can be determined as a function of the amount of charge added to the refrigeration system and/or as a function of an estimated total charge volume of the refrigeration system. In some examples, the amount of time waited at step 221 can be determined based on a linear correlation between an amount of refrigerant added and wait time. In some examples, controller 104 can wait to output a charge adjustment value for the charge to be adjusted at either step 210 or 220 based on elapsed time between iterations of steps 210 or 220. The wait time can be required to ensure the field system has reached steady state, improving accuracy of future calculations and charge adjustments.

Controller 104 can be configured to execute the method of FIG. 2 to determine a refrigeration charge percentage and a charge adjustment percentage or weight. Controller 104 can include circuitry, memory, and user input devices. Controller 104 can also include other components commonly found in electronic controllers, such as analog-to-digital converters that may convert analog input from the sensors to digital signals useable by circuitry, clocks, signal conditioners, signal filters, voltage regulators, current controls, modulating circuitry, input ports, output ports and the like. Controller 104 can also include appropriate input ports for receiving sensor inputs and user inputs. For example, a user of refrigeration system 100A (FIG. 1A) may input system conditions into the memory of controller 104 through user interface 106. The memory may comprise non-volatile random access memory (NVRM), read only memory, physical memory, optical memory or the like. Controller 104 may comprise any suitable computing device such as an analog circuit, or a digital circuit, such as a microprocessor, a microcontroller, an application-specific integrated circuit (ASIC) or a digital signal processor (DSP). A similarly configured controller can be used for any of the methods described below.

Figure 3:
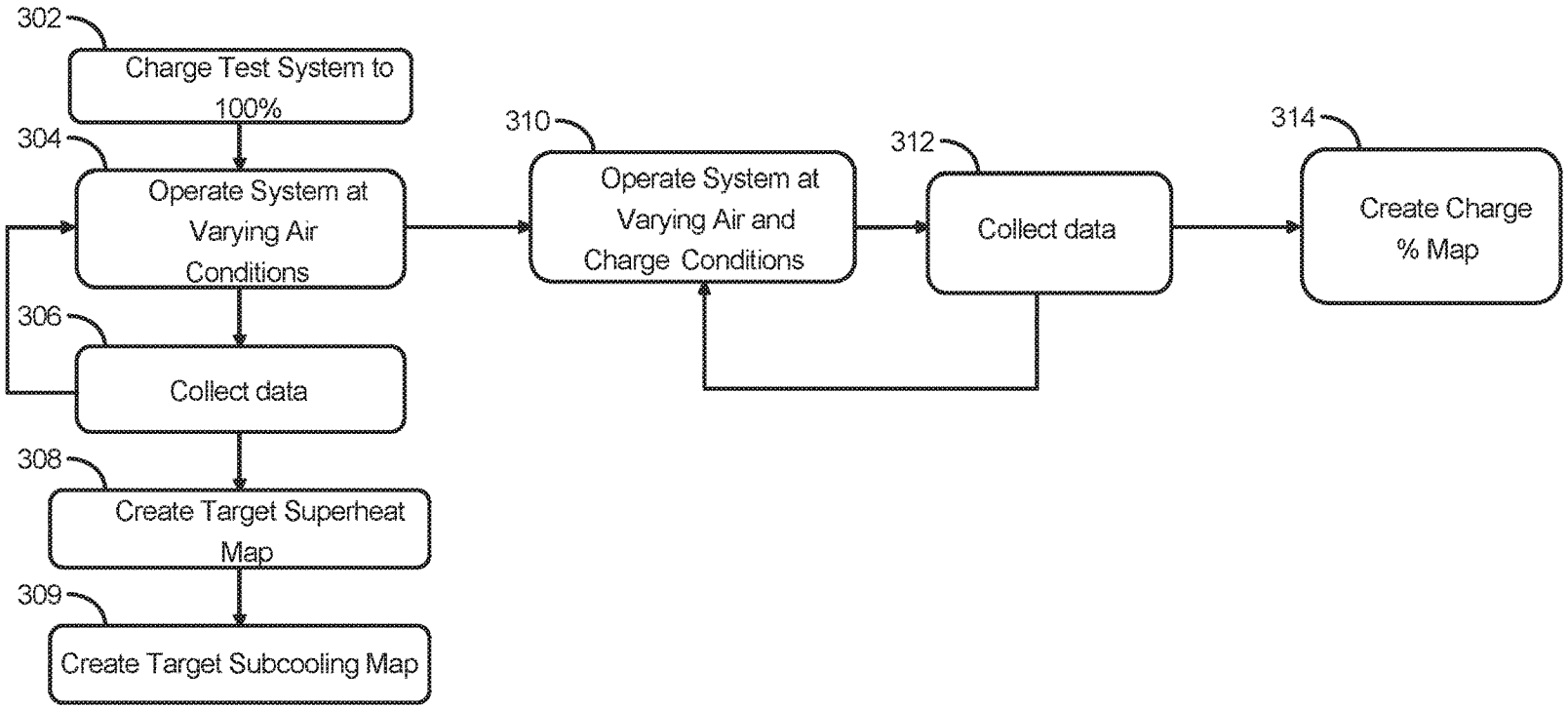
FIG. 3 illustrates a flow diagram of an example method of developing calculation maps for charging the refrigeration system of FIG. 1.

FIG. 3 illustrates a flow diagram of an example method of developing calculation maps for charging the refrigeration system of FIG. 1. Calculation maps can be determined using a test refrigeration system (such as refrigeration systems 100A, 100B, or 100C) in a lab or in the field under controlled conditions. A map creation method in a lab may include a lab computer that can include a controller (or other computing device) and a user interface, such as those of FIGS. 1A-IC. Following data collection, analysis can be performed using the methods disclosed herein to create maps. The resulting maps comprising, in some examples, correlation equations and data tables can be transferred to controller 104, for example.

At step 302, the test system can be charged to a 100% charge. That is, the test refrigeration system can be charged so that it operates at substantially ideal refrigerant pressures and temperatures at common operating conditions. Common operating conditions can be, for example, an outdoor dry bulb temperature of 95° Fahrenheit (35° Celsius) and an outdoor wet bulb temperature 75° Fahrenheit (24° Celsius), and an indoor dry bulb return air temperature of 80° Fahrenheit (27° Celsius) and an indoor wet bulb return air wet bulb temperature of 67° Fahrenheit (19° Celsius).

After the test refrigeration system is charged to 100%, the test system can be operated at varying air conditions at step 304 where data can be collected at step 306 for each operating condition. For example, superheat data, such as the suction pressure and suction temperature, can be measured by suction pressure sensor 130 and suction temperature sensor 132, respectively, and can be collected and stored by controller 104 at each operating condition. Similarly, subcooling data, such as the liquid pressure and liquid temperature, can be measured by liquid pressure sensor 134 and liquid temperature sensor 136, respectively, and can be collected and stored for controller 104 at each operating condition. In some examples, a field liquid pressure can be based on a measured temperature within a coil that can be converted to a pressure. For example, a saturation temperature and a condensing temperature can be determined by determining a measured condensing temperature within a condenser or a measured evaporation temperature within an evaporator, where the temperature is then converted to a condensing temperature or an evaporation temperature, respectively.

The indoor wet bulb and dry bulb temperatures can be measured by temperature sensors in indoor air zone 108 and can be transmitted to controller 104 for storage. Similarly, the outdoor wet bulb and dry bulb temperatures can be measured by temperature sensors in outdoor air zone 110 and can be transmitted to controller 104 for storage.

From the collected pressure and temperature data, the superheat and subcooling can be calculated at each variation of the operating conditions. At step 304, varying operating conditions can include variations of the indoor wet bulb temperature, indoor dry bulb temperature, and outdoor dry bulb temperature, for example. After data has been collected at step 306, a target superheat map and a target subcooling map can be created at step 308. The target superheat map can be created for controller 104, in one example, using the superheat data and one or more of the indoor wet bulb temperature, indoor dry bulb temperature, and outdoor dry bulb temperature. In some systems, such as a system using microchannel coils, for example, a model using all three variables (indoor wet bulb temperature, indoor dry bulb temperature, and outdoor dry bulb temperature) may be required to accurately determine a target superheat. In other systems, such as a system using tube and fin coils, only two variables may be required to accurately determine a target superheat.

The target superheat map can be an empirical correlation between a given indoor wet bulb temperature, indoor dry bulb temperature, outdoor dry bulb temperature, and a superheat value of a refrigeration system charged to 100%, where indoor wet bulb temperature, indoor dry bulb temperature, and outdoor dry bulb temperature are independent variables and a superheat value is a dependent variable. The target superheat map can be used to establish a target superheat for a refrigeration system at a given set of one or more conditions, such as the indoor wet bulb temperature, indoor dry bulb temperature, and outdoor dry bulb temperature, as described further below.

The target subcooling map can be created for controller 104, at step 209, in one example, using the subcooling data and one or more of the indoor wet bulb temperature, indoor dry bulb temperature, and outdoor dry bulb temperature. The target subcooling map can be an empirical correlation between a given indoor wet bulb temperature, indoor dry bulb temperature, outdoor dry bulb temperature, and a subcooling value of a refrigeration system charged to 100%, where indoor wet bulb temperature, indoor dry bulb temperature, and outdoor dry bulb temperature are independent variables and a subcooling value is a dependent variable. The target subcooling map can be used to establish a target subcooling for a refrigeration system at a given set of one or more conditions, such as the indoor wet bulb temperature, indoor dry bulb temperature, and outdoor dry bulb temperature, as described further below.

After step 304, step 310 can be performed each of the operating conditions can be varied at different charges of the test system. For example, at a given charge of the test system, the indoor wet bulb temperature, indoor dry bulb temperature, and outdoor dry bulb temperature can be changed.

After the charge and air conditions are varied at step 310, step 312 can be performed where data, such as superheat and subcooling data, can be collected. In some examples, a liquid line pressure and a liquid line temperature of the test refrigeration system can be measured. Liquid line pressures and temperatures can be collected by liquid pressure sensor 134 and liquid temperature sensor 136, respectively, and sent to controller 104. Controller 104 can then store the measurement data. Then, as part of step 312, the system subcooling can be determined based on liquid line pressure and temperature measurements, and each subcooling calculation can be stored for each charge condition. Superheat data can be collected and stored similarly. Through iterations of steps 310, 312, and 314, the charge of the test system can be varied above 100% charge and below 100% charge by increments of 10%, 7%, 6%, 5%, 1%, 0.1%, or any other incremental step.

After data is collected at step 312 for varied test system operating conditions and varied test system charge conditions, a charge percentage map can be created at step 314. The charge percentage map can created for controller 104, in one example, as a function of the subcooling data and at least one of the indoor wet bulb temperature, indoor dry bulb temperature, and outdoor dry bulb temperature operating conditions. The charge percentage map can created for controller 104, in one example, as a function of the superheat data and at least one of the indoor wet bulb temperature, indoor dry bulb temperature, and outdoor dry bulb temperature operating conditions, where indoor wet bulb temperature, indoor dry bulb temperature, outdoor dry bulb temperature, and a subcooling value are independent variables and a charge percentage is a dependent variable. In some examples, both superheat and subcooling can be used. For example, indoor wet bulb temperature, indoor dry bulb temperature, outdoor dry bulb temperature, a superheat value, and a subcooling value can be independent variables and a charge percentage can be a dependent variable. In some examples, additional operating conditions, such as outdoor wet bulb can be used. The charge percentage map can be an empirical correlation between a given indoor wet bulb temperature, indoor dry bulb temperature, outdoor dry bulb temperature, subcooling value, superheat value, and a percentage charge of a refrigeration system. The charge percentage map can be used to establish a charge percentage for a system given one or more of that system's conditions, such as the subcooling temperature, indoor wet bulb temperature, indoor dry bulb temperature, outdoor dry bulb temperature, and outdoor wet bulb temperature, as described further below.

Each of these variables, subcooling temperature, indoor wet bulb temperature, indoor dry bulb temperature, outdoor dry bulb temperature, and outdoor wet bulb temperature can be substantially independent of one another. By using several independent variables, the maps developed can be used to more accurately predict the charge and charge adjustment of a refrigeration system.

In some examples, other variables that are similar to those discussed herein can be used to determine a target map and a charge percentage map. For example, in lieu of an indoor wet bulb temperature and an indoor dry bulb temperature, relative humidity can be used to develop a map.

Charge percentage maps, such as those created as part of step 314 can be created in an external computer and stored in controller 104. In some examples, the charge percentage maps can be created as a system (such as refrigeration system 100A) is operating. The charge percentage maps can be stored in the form of data (e.g. lookup tables), or correlations such polynomial fit equations based on empirical data collected in the steps of the method of FIG. 3.

Each map created can be used to cover a single size and type of refrigeration system. In some examples, the maps created in the method of FIG. 3 can be used to determine a refrigeration charge adjustment for a refrigeration system having a fixed orifice and a capacity of 2 cooling tons (7 kilowatts). In other examples, the maps created in the method of FIG. 3 can be used to determine a refrigeration charge adjustment for a range of refrigeration systems, such as systems having a fixed orifice and a capacity of 2 cooling tons (7 kilowatts) to 4 cooling tons (14 kilowatts).

The maps created in steps 308 and 314 may be particularly useful, in some examples, for determining charge for a fixed orifice system, such as in the method of FIG. 2 including steps 202-208, and as described below in FIGS. 5-7.

Figure 4:
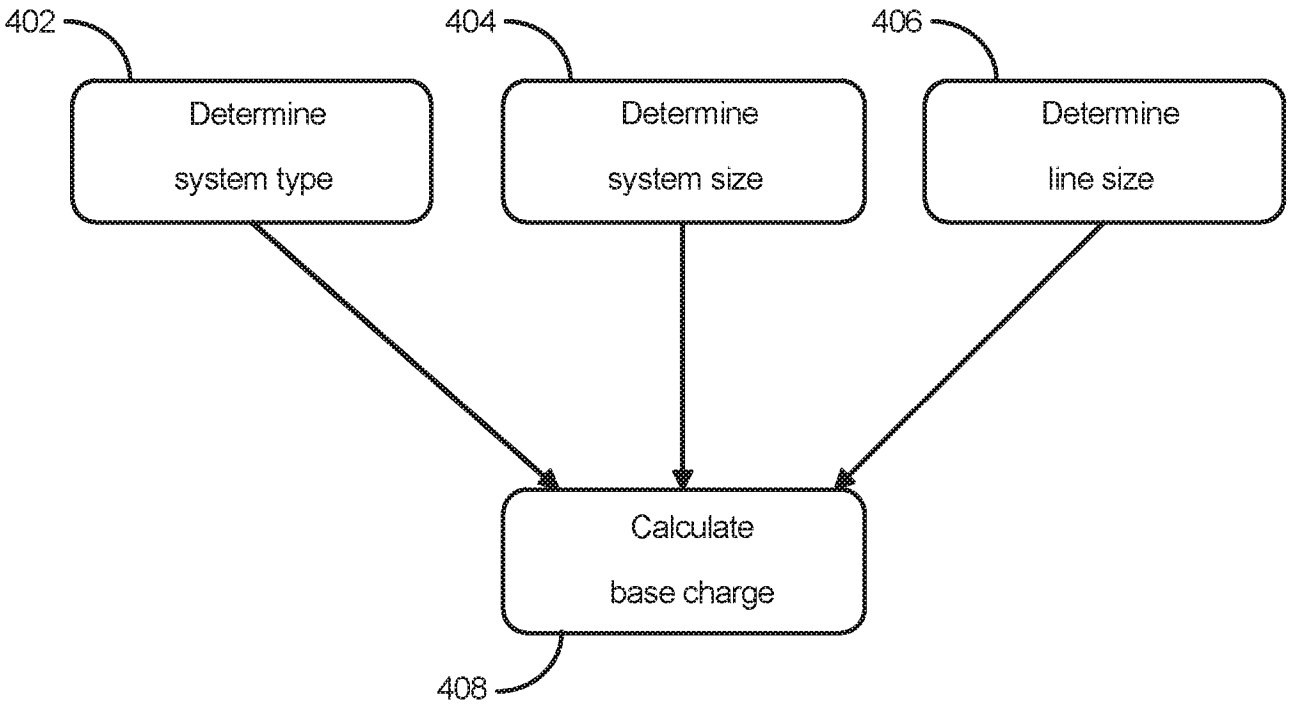
FIG. 4 illustrates a flow diagram of an example method of calculating a base charge for charging the refrigeration system of FIG. 1.

FIG. 4 illustrates a flow diagram of an example method of calculating a base charge for charging the refrigeration system of FIG. 1.

At step 402, the type of refrigeration system to be analyzed can be determined. This can include factors such as whether the system has a fixed orifice, TXV, or EEV, for example. At step 404, the size, or capacity, of the system can be determined. At step 406, the line sizes of the system can be determined. In some examples, the sizes may be limited to diameters and length of only the suction line and the liquid line, because the dimensions of the discharge line and distribution line are somewhat consistent, or can be known for a given system type and capacity. In some other examples, the diameters and lengths of the discharge line and distribution line can also be determined. At step 408, a base charge can be calculated as a function of the system type, the system size, and the line sizes.

In operation of one embodiment, controller 104 (of any of refrigeration systems 100A, 100B, and 100C) can receive the system type, system size, and line size from user interface 106. Controller 104 can then calculate the base charge as a function of the received system type, system size, and line size and send the base charge to user interface 106 and can also store the base charge of the refrigeration system for future use.

Figure 5:
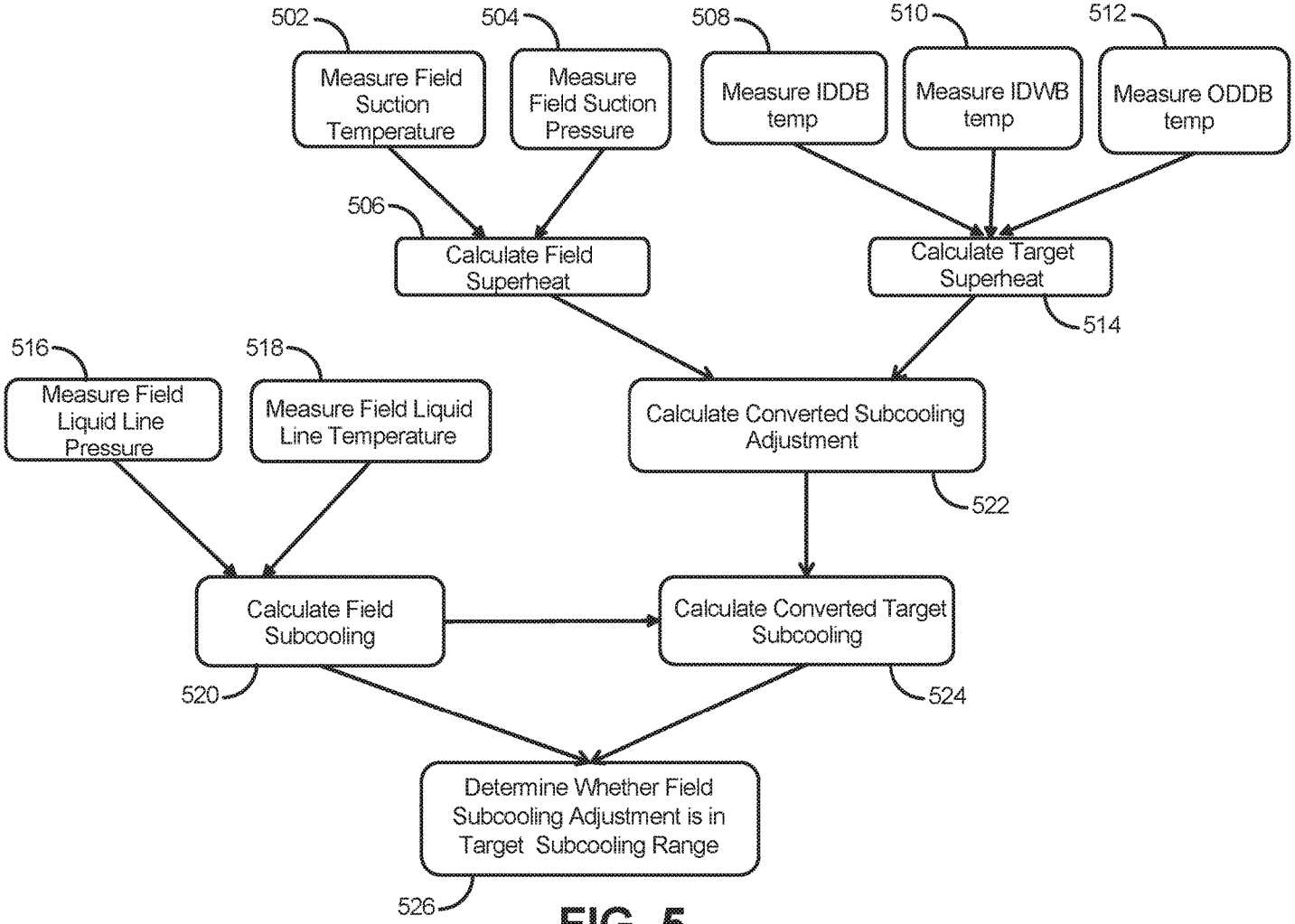
FIG. 5 illustrates a flow diagram of an example method of calculating a subcooling for charging the refrigeration system of FIG. 1.

FIG. 5 illustrates a flow diagram of an example method of calculating a subcooling for charging the refrigeration system of FIG. 1. The method of FIG. 5 can be used as part of a method for determining a charge adjustment for a field refrigeration system having a fixed orifice, such as refrigeration system 100A, as determined by step 202 of FIG. 2.

At step 502 the field suction temperature can be measured, for example by suction temperature sensor 132. At step 504 the field suction pressure can be measured, for example by suction pressure sensor 130. As part of steps 502 and 504, the field suction temperature and pressure measurements can be sent to controller 104 by suction temperature sensor 132 and suction pressure sensor 130, respectively. After receiving the measured field suction temperature and measured field suction pressure, controller 104 can perform step 506, where field superheat can be calculated as a function of the measured field suction temperature and measured field suction pressure.

At step 508, the indoor dry bulb temperature can be measured, for example, using a dry bulb temperature sensor within indoor zone 108. As part of step 508, the dry bulb temperature sensor can send the temperature measurement to controller 104. At step 510, the indoor wet bulb temperature can be measured, for example, using a wet bulb temperature sensor within indoor zone 108. As part of step 510, the wet bulb temperature sensor can send the temperature measurement to controller 104. At step 512, the outdoor dry bulb temperature can be measured, for example, using a temperature sensor within outdoor zone 110. In another example, the indoor wet bulb temperature can be determined using a relative humidity sensor and converting the measured relative humidity to indoor wet bulb. As part of step 512, the sensor can send the temperature measurement to controller 104. At step 514, a target superheat can be calculated as a function of the measured field indoor dry bulb, the measured field indoor wet bulb, and the measured field outdoor dry bulb. Controller 104 can perform this calculation using the target superheat map determined in step 308 of FIG. 3, where a target superheat can be output as a function of the measured field indoor dry bulb, the measured field indoor wet bulb, and the measured field outdoor dry bulb.

At step 516, a field liquid line pressure can be measured, for example, using liquid pressure sensor 134 of refrigeration system 100A. As part of step 516, liquid pressure sensor 134 can send the field liquid line pressure measurement to controller 104. At step 518, a field liquid line temperature can be measured, for example, using liquid temperature sensor 136 of refrigeration system 100A. As part of step 518, liquid temperature sensor 136 can send the field liquid line temperature measurement to controller 104. At step 520, the field subcooling can be calculated. In one example, controller 104 can calculate the field subcooling based on received values of liquid line pressure and liquid line temperatures from liquid pressure sensor 134 and liquid temperature sensor 136, respectfully.

At step 522, a converted subcooling adjustment can be calculated as a function of the field superheat calculated at step 506 and the target superheat calculated at step 514. In the calculation at step 522, the converted subcooling adjustment value can be determined from the target superheat and the field superheat using an empirical correlation derived from test systems, in some examples. In some examples, controller 104 can calculate the converted subcooling adjustment based on stored field superheat values and target superheat values.

At step 524, a converted target subcooling (Sct) can be calculated as a function of converted subcooling adjustment (Sca) and the field subcooling (Sf). In some examples, controller 104 can calculate the converted target subcooling using the equation:

$$Sct=Sf+Sca \qquad \text{Equation 3}$$

At step 526, it can be determined whether a field subcooling adjustment, or subcooling difference, is in the target subcooling range using the field subcooling and the converted target subcooling. In some examples, controller 104 can subtract the converted target subcooling (Sct) from the field subcooling (Sf), as given by the equation:

$$\text{Subcooling adjustment}=|Sf-Sct| \qquad \text{Equation 4}$$

Then, the subcooling adjustment can be compared, for example by controller 104, to a subcooling range value. For example, the field subcooling can be 5° Fahrenheit (2.3° Celsius), the target subcooling can be 10° Fahrenheit (5.6° Celsius), and the range value can be 2° Fahrenheit (1° Celsius). In this example, the subcooling adjustment can be 5° Fahrenheit (2.3° Celsius), which is greater than the range value of 2° Fahrenheit (1° Celsius). As a result, it can be determined that the subcooling adjustment is out of the target subcooling range. In another example, the field subcooling can be 11° Fahrenheit (6.1° Celsius), making the subcooling adjustment 1° Fahrenheit (0.5° Celsius), which is in the target subcooling range. Whether or not the field subcooling adjustment is within the target subcooling range can be used in further methods, as discussed below.

Figure 6:
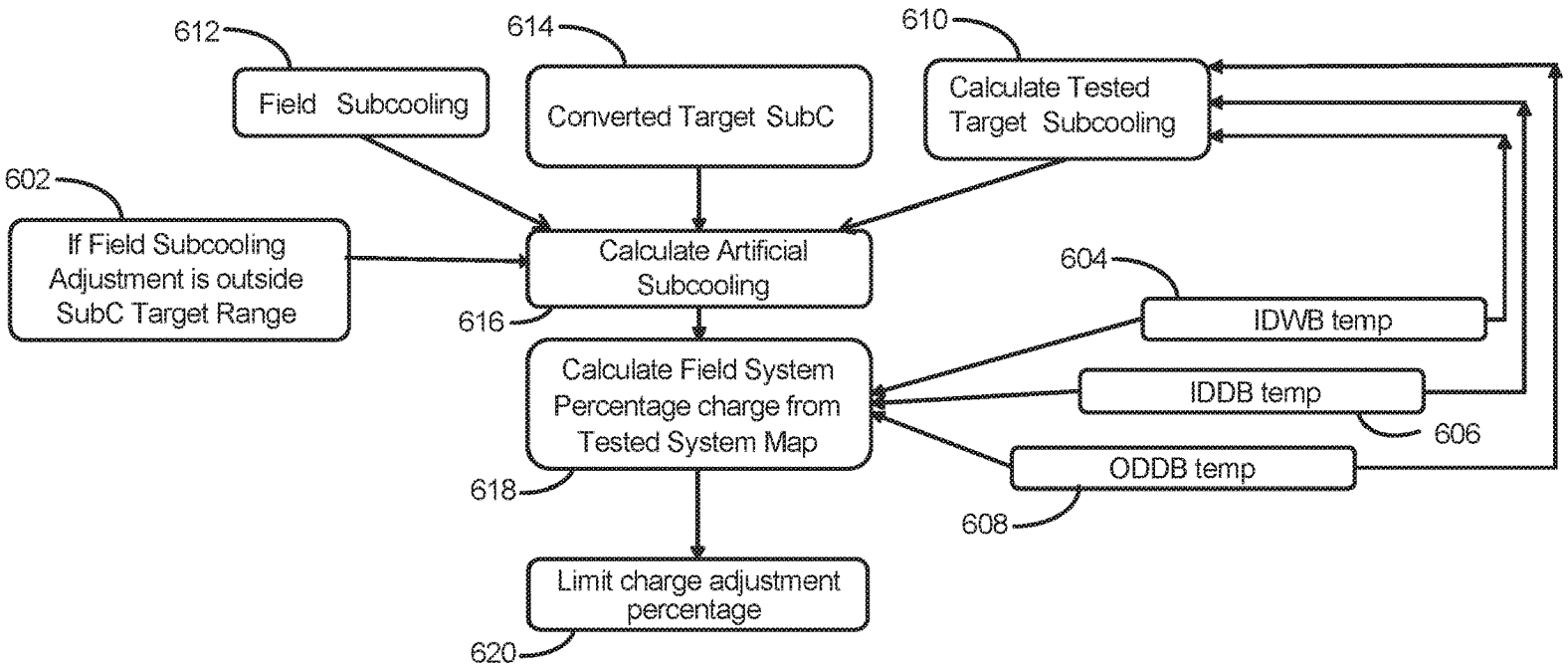
FIG. 6 illustrates a flow diagram of an example method of calculating a charge adjustment for charging the refrigeration system of FIG. 1.

FIG. 6 illustrates a flow diagram of an example method of calculating a charge adjustment for charging the refrigeration system of FIG. 1.

The method of FIG. 6 can begin at step 602, when it has been determined that the field subcooling adjustment is outside the subcooling target range, for example in step 526 of FIG. 5. At step 604, the measured field indoor wet bulb temperature can be measured and communicated to controller 104, or the most recent value can be retrieved by controller 104, such as the value determined in step 510 of FIG. 5. At step 606, the measured field indoor dry bulb temperature can be measured and communicated to controller 104, or the most recent value can be retrieved by controller 104, such as the value determined in step 518 of FIG. 5. At step 608, the measured field outdoor dry bulb temperature can be measured and communicated to controller 104, or the most recent value can be retrieved by controller 104, such as the value determined in step 512 of FIG. 5. At step 610, tested target subcooling can be determined as a function of the measured field indoor dry bulb, the measured field indoor wet bulb, and the measured field outdoor dry bulb. The tested target subcooling can be calculated by controller 104 using data collected from the test system. For example, the target subcooling map can be used in step 610 to determine the target subcooling as a function of a measured field indoor wet bulb temperature, a measured field indoor dry bulb temperature, and a measured field outdoor dry bulb temperature.

At step 616, the artificial subcooling can be calculated using field subcooling 612, converted target subcooling 614, and the calculated target subcooling from step 610. Field subcooling 612 can be imported, for example from step 520 of the method of FIG. 5. For example, controller 104 can recall the field subcooling value from a stored location. Similarly, converted target subcooling 614 can be imported from step 524 of the method of FIG. 5. For example, controller 104 can recall the converted target subcooling value from a stored location. The artificial subcooling can be determined based on several subcooling values in some examples, as shown in FIG. 6. Using the field subcooling, converted target subcooling and target subcooling of the tested refrigeration system for a selected map can be used to compensate for the fact that the field refrigeration system being charged may be modeled using maps that cover systems of different sizes and having different sized orifices.

At step 618, the field system percentage charge can be calculated using charge percentage map created in step 314 of FIG. 3. The charge percentage map can be designed to determine the field system percentage charge as a function of the artificial subcooling from step 616, the indoor wet bulb temperature of the field system, the indoor dry bulb temperature of the field system, and the outdoor dry bulb temperature of the field system. In operation of one example, controller 104 can be used to perform step 616, where controller 104 can retrieve the inputs for step 616 from other steps. For example, the indoor wet bulb temperature of the field system can be retrieved from step 604, the indoor dry bulb temperature of the field system can be retrieved from step 606, and the outdoor dry bulb temperature of the field system can be retrieved from step 608.

In some embodiments, the charge percentage map can be created so that the field system percentage charge can be determined using fewer conditions of the field system, such as only using artificial subcooling, the indoor wet bulb temperature of the field system and the outdoor dry bulb temperature of the field system. In some other embodiments, the field subcooling can be used in place of the artificial subcooling. In some embodiments, the charge percentage map can be created so that the field system percentage charge can be determined as a function of more conditions, such as field superheat.

At step 620, the charge adjustment percentage can be limited and the charge adjustment weight can be calculated, in accordance with the method of FIG. 7, discussed below.

Figure 7:
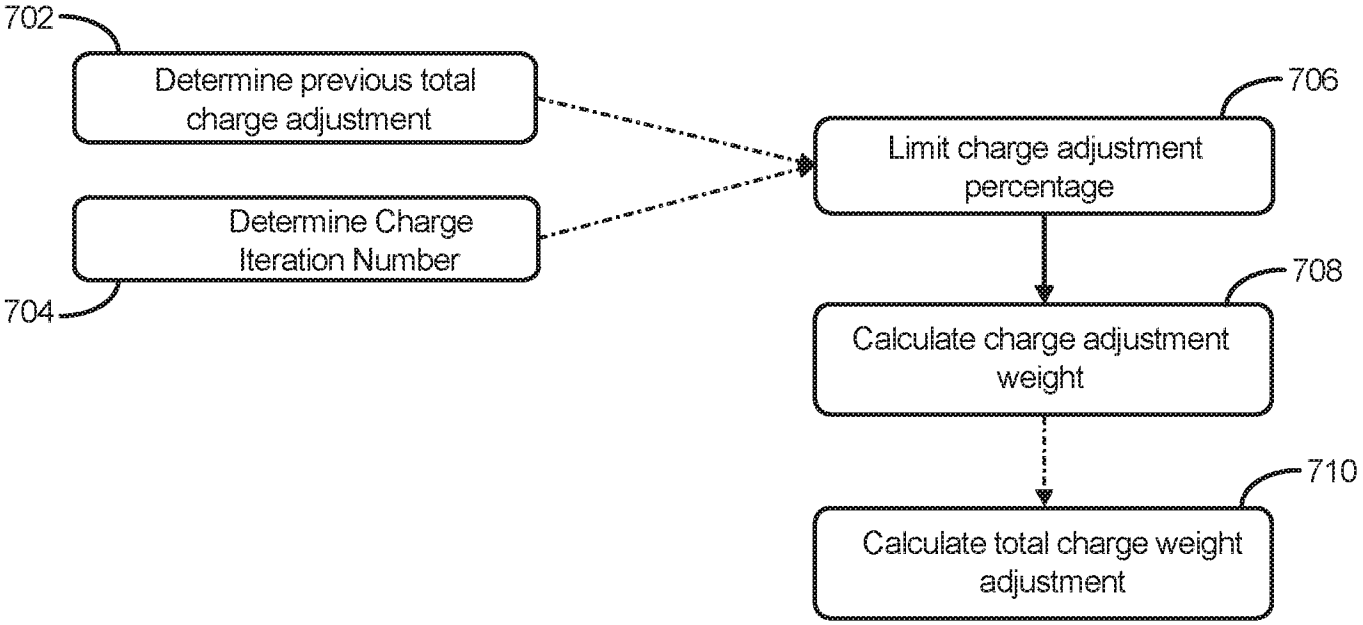
FIG. 7 illustrates a flow diagram of an alternative example method of limiting a charge adjustment for charging the refrigeration system of FIG. 1.

FIG. 7 illustrates a flow diagram of an alternative example method of limiting a charge adjustment for charging the refrigeration system of FIG. 1.

At step 702, the previous total charge adjustment to the system can be determined. The previous charge adjustment can be determined by controller 104 based on stored or recorded values of charge weight previously added and/or subtracted, for example by summing adjustments made at step 208 of FIG. 2. In some examples, controller 104 can receive a charge previously adjusted from user interface 106.

At step 704, the number of charge iterations can be determined. In some examples, the number of charge iterations can be determined by controller 104 by counting the number of times controller 104 has performed step 208 of FIG. 2. In some examples, the number of charge iterations can be received at user interface 106 and delivered to controller 104.

At step 706, the charge adjustment percentage determined at step 618 can be limited by one or both of the previous total charge added from step 702 and the number of charge iterations from step 704. In some examples, the charge adjustment percentage can be limited to 15% on the first charge adjustment iteration and limited to 5% on every iteration thereafter. In other examples, the charge adjustment can be limited to larger increments, such as 20% or any charge between such as 6% to 19%. And in yet other examples, the charge adjustment percentage can be limited to smaller increments, such as 1%, 2%, 3%, or 4%. The total charge percentage change can also be limited to, for example 30%. These limitations can help prevent over-charging, and damage to components of the refrigeration system, such as refrigeration system 100A of FIG. 1.

In some other examples, the charge adjustment percentage can be limited based on the previous total charge added, as determined as step 702. For example, if it has been determined that 2.2 pounds (1 kilogram) of refrigerant has been added to, for example, refrigeration system 100A, the charge adjustment percentage can be limited accordingly. For example, if 1 kilogram is over the base charge (from step 408 of FIG. 4), the charge adjustment percentage can be limited to additions of 1%, and the like. In some other examples, an estimated system charge volume can be determined from other methods, or received from user interface 106.

At step 708, the charge adjustment weight can be determined as a function of the charge adjustment percentage from step 624, as the charge adjustment percentage can be converted into a refrigerant weight to be added or subtracted from a field refrigeration system, for example, refrigeration system 100A. In some examples, calculating the charge adjustment weight can be determined as a function of the base charge (from step 408 of FIG. 4). The adjustment weight determined at step 708 can then be added to or subtracted from the field system, such as in step 208 of FIG. 2. At step 710, the charge adjustment weight can be added to or subtracted from the previous total charge adjustment (total charge added or subtracted) to be used in future iterations of the methods described above.

Figure 8:
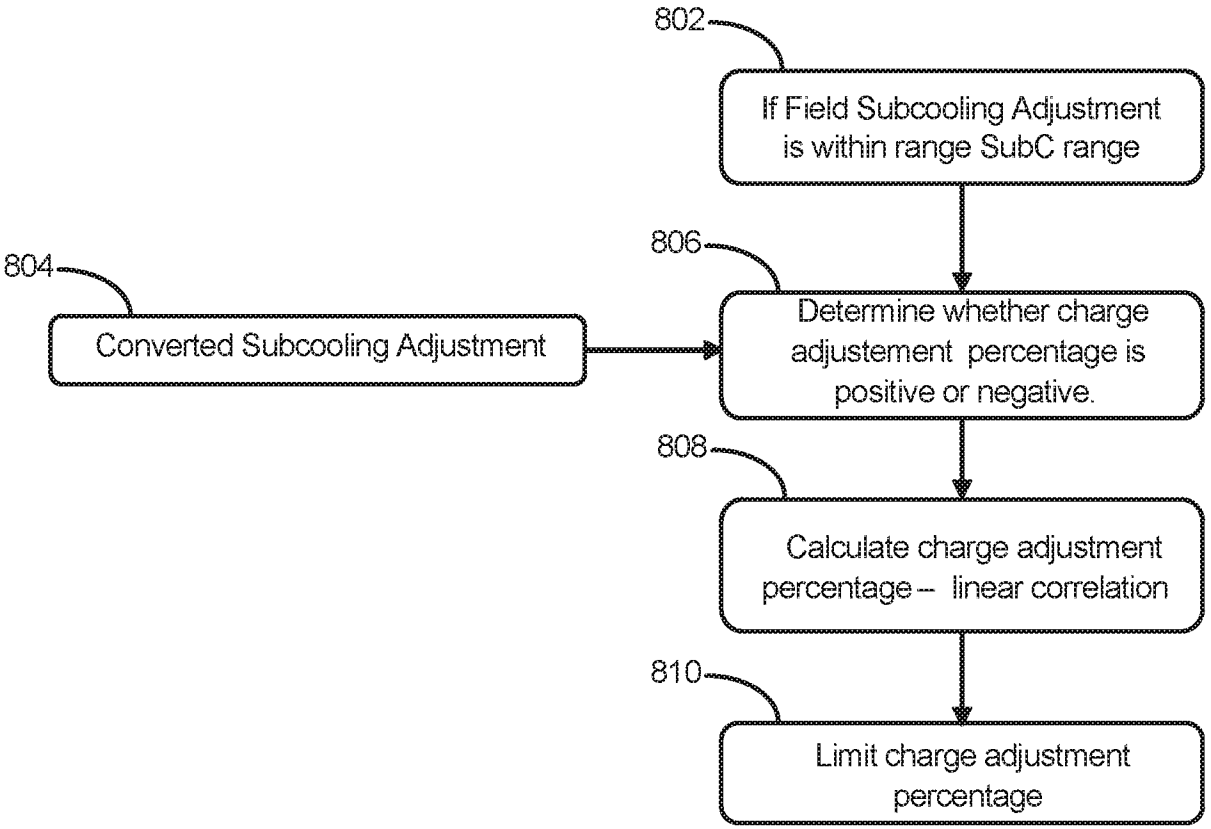
FIG. 8 illustrates a flow diagram of an alternative example method of calculating a charge adjustment for charging the refrigeration system of FIG. 1.

FIG. 8 illustrates a flow diagram of an alternative example method of calculating a charge adjustment for charging the refrigeration system of FIG. 1.

The method of FIG. 8 can begin at step 802, when it has been determined that the field subcooling adjustment is within the subcooling target range, for example in step 526 of FIG. 5.

Step 804 can be to import the converted subcooling adjustment, for example from step 522 of FIG. 5. At step 806, the converted subcooling adjustment can be used to determine whether the adjustment is positive or negative. At step 808, the charge adjustment percentage can be determined as a function of the converted subcooling adjustment. The determination in step 808 can be a simple linear correlation between the converted subcooling adjustment and the charge adjustment percentage to be made. In some examples, a first equation can be used to determine the charge adjustment percentage when the adjustment is determined to be positive at step 806 and a second equation can be used determine the charge adjustment percentage when the adjustment is determined to be negative at step 806. In other examples, the same equation can be used to determine the charge adjustment percentage, regardless of whether the charge adjustment is positive or negative. That is, step 806 can be skipped.

At step 810, the charge adjustment percentage can be limited and the charge adjustment weight can be calculated in accordance with the method of FIG. 7.

Figure 9:
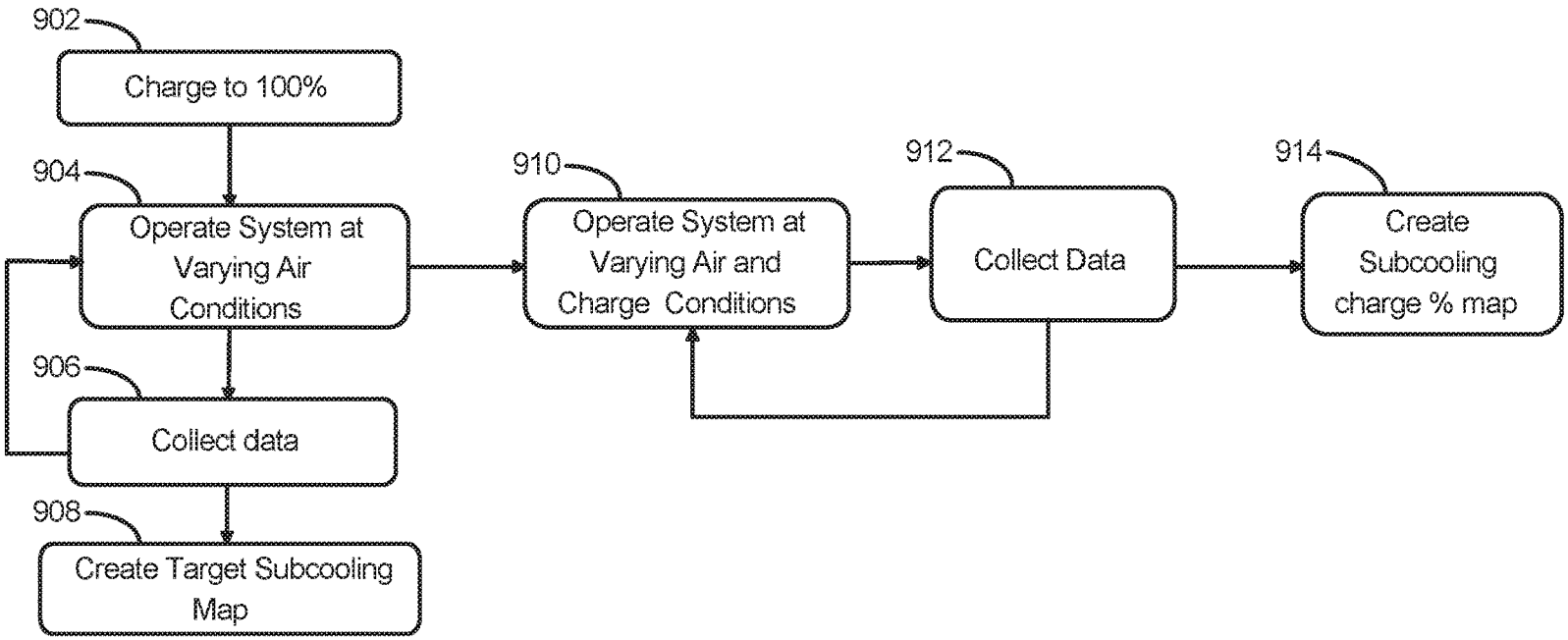
FIG. 9 illustrates a flow diagram of another example method of developing calculation maps for charging the refrigeration system of FIG. 1.

FIG. 9 illustrates a flow diagram of another example method of developing calculation maps for charging the refrigeration system of FIG. 1. Calculation maps can be determined using a refrigeration system (such as refrigeration systems 100A, 100B, or 100C) in a lab under test conditions. A map creation method in a lab may include a lab computer that can include a controller (or other computing device) and a user interface, such as those of FIGS. 1A-IC. Following data collection, analysis can be performed using the methods disclosed herein to create maps. The resulting maps comprising, in some examples, correlation equations and data tables can be transferred to controller 104, for example.

At step 902, the test system can be charged to a 100% charge. That is, the test refrigeration system can be charged so that it operates at substantially ideal refrigerant pressures and temperatures at common operating conditions. Common operating conditions can be, for example, an outdoor dry bulb temperature of 95° Fahrenheit (35° Celsius) and an outdoor wet bulb temperature 75° Fahrenheit (24° Celsius), and an indoor dry bulb return air temperature of 80° Fahrenheit (27° Celsius) and an indoor wet bulb return air wet bulb temperature of 67° Fahrenheit (19° Celsius).

After the test refrigeration system is charged to 100%, the test system can be operated at varying air conditions at step 904 where data can be collected at step 906 for each operating condition. For example, subcooling data, such as the liquid pressure and liquid temperature, can be measured by liquid pressure sensor 134 and liquid temperature sensor 136, respectively, and can be collected and stored for controller 104 at each operating condition. The indoor wet bulb temperatures can be measured by temperature sensors in indoor air zone 108 and can be transmitted to controller 104 for storage. Similarly, the outdoor wet bulb and dry bulb temperatures can be measured by temperature sensors in outdoor air zone 110 and can be transmitted to controller 104 for storage.

From the collected pressure and temperature data, the subcooling can be calculated at each variation of the operating conditions. At step 904, varying operating conditions can include variations of the indoor wet bulb temperature and outdoor dry bulb temperature, for example.

After data has been collected at step 906, a target subcooling map can be created at step 908. The target subcooling map can be created for controller 104, in one example, using the subcooling data and one or more of the indoor wet bulb temperature, indoor dry bulb temperature, and outdoor dry bulb temperature. The target subcooling map can be an empirical correlation between a given indoor wet bulb temperature, indoor dry bulb temperature, outdoor dry bulb temperature, and a subcooling value of a refrigeration system charged to 100%, where indoor wet bulb temperature, and outdoor dry bulb temperature are independent variables and a subcooling value is a dependent variable. The target subcooling map can be used to establish a target subcooling for a refrigeration system at a given set of one or more conditions, such as the indoor wet bulb temperature, indoor dry bulb temperature, and outdoor dry bulb temperature, as described further below.

After step 904, step 910 can be performed each of the operating conditions can be varied at different charges of the test system. For example, at a given charge of the test system, the indoor wet bulb temperature, indoor dry bulb temperature, and outdoor dry bulb temperature can be changed.

After the charge and air conditions are varied at step 910, step 912 can be performed where data can be collected, such temperatures, subcooling, and superheat data, and sent to controller 104. Controller 104 can then store the collected data. Then, as part of step 912, the system subcooling can be stored for each charge condition. Through iterations of steps 910, 912, and 914, the charge of the test system can be varied above 100% charge and below 100% charge by increments of 10%, 7%, 6%, 5%, 1%, 0.1%, or any other incremental step.

After subcooling data is collected at step 912 for varied test system operating conditions and varied test system charge conditions, a charge percentage map can be created at step 914 for controller 104. Charge percentage maps, such as those created as part of step 914 can be created in an external computer and stored in controller 104. The charge percentage maps can be stored in the form of data (e.g. lookup tables), or correlations such polynomial fit equations based on empirical data collected in the steps of the method of FIG. 10.

The charge percentage map can created, in one example, as a function of the subcooling data and at least one of the indoor wet bulb temperature and outdoor dry bulb temperature operating conditions. In some examples, additional operating conditions, such as outdoor wet bulb and indoor wet bulb can be used. The charge percentage map can be an empirical correlation between a given indoor wet bulb temperature, outdoor dry bulb temperature, subcooling value and a percentage charge of a refrigeration system, where indoor wet bulb temperature, outdoor dry bulb temperature, and subcooling are independent variables, and charge percentage is a dependent variable. The charge percentage map can be used to establish a charge percentage for a system given one or more of that system's conditions, such as the subcooling temperature, indoor wet bulb temperature, outdoor dry bulb temperature, and outdoor wet bulb temperature, as described further below.

Each of these variables, indoor wet bulb temperature, outdoor dry bulb temperature, and subcooling, can be substantially independent of one another. By using several independent variables, the maps developed can be used to more accurately predict the charge and charge adjustment of a refrigeration system.

In some examples, the maps created in the method of FIG. 9 can be used to determine a refrigeration charge adjustment for a refrigeration system having a controllable orifice (such as a TXV or EEV) and a capacity of 2 cooling tons (7 kilowatts). In other examples, the maps created in the method of FIG. 9 can be used to determine a refrigeration charge adjustment for a range of refrigeration systems, such as systems having a controllable orifice (such as a TXV or EEV) and a capacity of 2 cooling tons (7 kilowatts) to 4 cooling tons (14 kilowatts).

The maps created in steps 908 and 914 may be particularly useful, in some examples, for determining charge for a TXV or EEV system, such as in the method of FIG. 2 including steps 210-220, and as described below in FIGS. 12-15.

Figure 10:
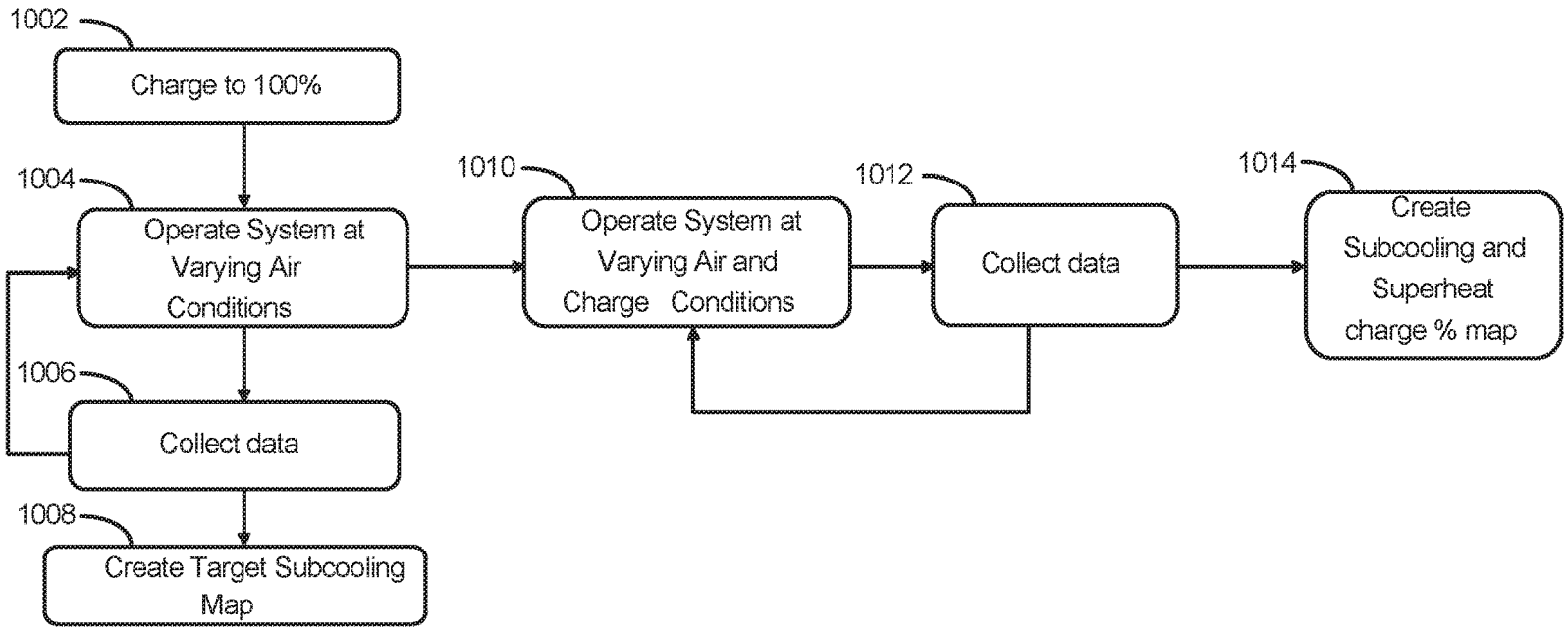
FIG. 10 illustrates a flow diagram of another example method of developing calculation maps for charging the refrigeration system of FIG. 1.

FIG. 10 illustrates a flow diagram of another example method of developing calculation maps for charging the refrigeration system of FIG. 1. Calculation maps can be determined using a refrigeration system (such as refrigeration systems 100A, 100B, or 100C) in a lab under test conditions. A map creation method in a lab may include a lab computer that can include a controller (or other computing device) and a user interface, such as those of FIGS. 1A-IC. Following data collection, analysis can be performed using the methods disclosed herein to create maps. The resulting maps comprising, in some examples, correlation equations and data tables can be transferred to controller 104, for example.

At step 1002, the test system can be charged to a 100% charge. That is, the test refrigeration system can be charged so that it operates at substantially ideal refrigerant pressures and temperatures at common operating conditions. Common operating conditions can be, for example, an outdoor dry bulb temperature of 95° Fahrenheit (35° Celsius) and an outdoor wet bulb temperature 75° Fahrenheit (24° Celsius), and an indoor dry bulb return air temperature of 80° Fahrenheit (27° Celsius) and an indoor wet bulb return air wet bulb temperature of 67° Fahrenheit (19° Celsius).

After the test refrigeration system is charged to 100%, the test system can be operated at varying air conditions at step 1004 where data can be collected at step 1006 for each operating condition. For example, subcooling data, such as the liquid pressure and liquid temperature, can be measured by liquid pressure sensor 134 and liquid temperature sensor 136, respectively, and can be collected and stored for controller 104 at each operating condition. The indoor wet bulb temperatures can be measured by temperature sensors in indoor air zone 108 and can be transmitted to controller 104 for storage. Similarly, the outdoor wet bulb and dry bulb temperatures can be measured by temperature sensors in outdoor air zone 110 and can be transmitted to controller 104 for storage.

From the collected pressure and temperature data, the subcooling can be calculated at each variation of the operating conditions. At step 1004, varying operating conditions can include variations of the indoor wet bulb temperature and outdoor dry bulb temperature, for example. After data has been collected at step 1006, a target subcooling map can be created at step 1008. The target subcooling map can be created for controller 104, in one example, using the subcooling data and one or more of the indoor wet bulb temperature and outdoor dry bulb temperature. The target superheat map can be an empirical correlation between a given indoor wet bulb temperature and outdoor dry bulb temperature, and a subcooling value of a refrigeration system charged to 100%, where indoor wet bulb temperature and outdoor dry bulb temperature are dependent variables, and target subcooling is a dependent variable. The target subcooling map can be used to establish a target subcooling for that system at a given set of one or more conditions, such as the indoor wet bulb temperature and outdoor dry bulb temperature, as described further below.

After step 1004, step 1010 can be performed where each of the operating conditions can be varied at different charges of the test system. For example, at a given charge of the test system, the indoor wet bulb temperature, indoor dry bulb temperature, and outdoor dry bulb temperature can be changed.

After the charge and air conditions are varied at step 1010, step 1012 can be performed where subcooling data can be collected, such as a liquid line pressure and a liquid line temperature of the test refrigeration system. Liquid line pressures and temperatures can be collected by liquid pressure sensor 134 and liquid temperature sensor 136, respectively, and sent to controller 104. Controller 104 can then store the measurement data. Then, as part of step 1012, the system subcooling can be determined based on liquid line pressure and temperature measurements, and each subcooling calculation can be stored for each charge condition. Superheat data can also be collected as part of step 1012, such as the suction pressure and suction temperature, which can be measured by suction pressure sensor 130 and suction temperature sensor 132, respectively, and can be collected and stored for controller 104 at each operating condition. Through iterations of steps 1010, 1012, and 1014, the charge of the test system can be varied above 100% charge and below 100% charge by increments of 10%, 7%, 6%, 5%, 1%, 0.1%, or any other incremental step.

After subcooling data is collected at step 1012 for varied test system operating conditions and varied test system charge conditions, a charge percentage map can be created at step 1014 for controller 104. Charge percentage maps, such as those created as part of step 1014 can be created in an external computer and stored in controller 104. The charge percentage maps can be stored in the form of data (e.g. lookup tables), or correlations such polynomial fit equations based on empirical data collected in the steps of the method of FIG. 10.

The charge percentage map can created, in one example, as a function of the subcooling data and superheat data, subcooling data, and at least one of the indoor wet bulb temperature and outdoor dry bulb temperature operating conditions. In some examples, additional operating conditions, such as outdoor wet bulb and indoor wet bulb can be used. The charge percentage map can be an empirical correlation between a given indoor wet bulb temperature, outdoor dry bulb temperature, subcooling value, superheat value, and a percentage charge of a refrigeration system, where indoor wet bulb temperature, outdoor dry bulb temperature, subcooling, and superheat are independent variables, and a percentage charge is a dependent variable. The charge percentage map can be used to establish a charge percentage for a system given one or more of that system's conditions, such as the subcooling temperature, superheat temperature, indoor wet bulb temperature, outdoor dry bulb temperature, and outdoor wet bulb temperature, as described further below.

In some examples, the maps created in the method of FIG. 3 can be used to determine a refrigeration charge adjustment for a refrigeration system having a controllable orifice (such as a TXV) and a capacity of 2 cooling tons (7 kilowatts). In other examples, the maps created in the method of FIG. 3 can be used to determine a refrigeration charge adjustment for a range of refrigeration systems, such as systems having a controllable orifice (such as a TXV) and a capacity of 2 cooling tons (7 kilowatts) to 4 cooling tons (14 kilowatts).

The maps created in steps 1008 and 1014 may be particularly useful, in some examples, for determining charge for a TXV or EEV orifice system, such as in the method of FIG. 2 including steps 210-220, and as described below in FIGS. 12-15.

Figure 11:
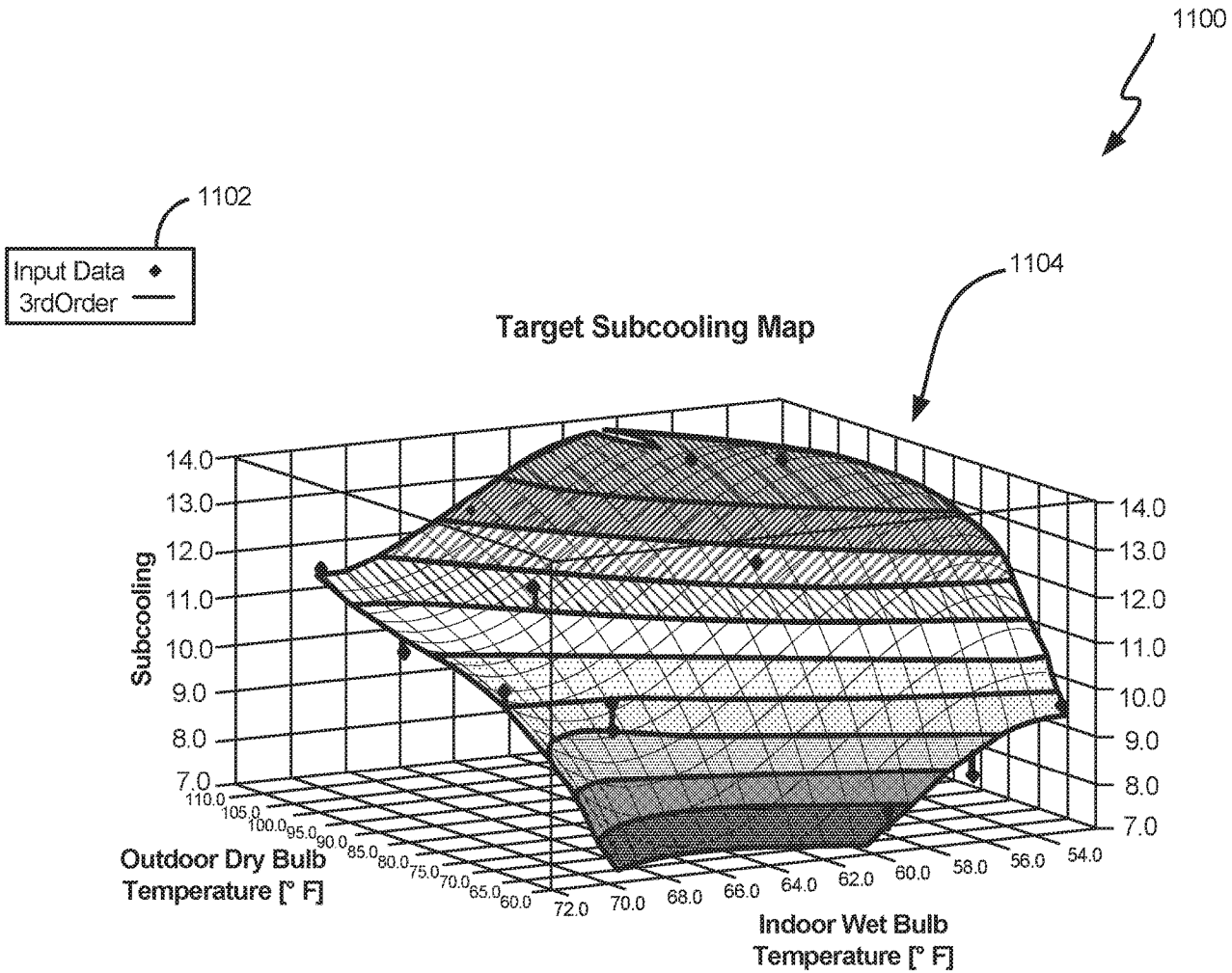
FIG. 11 illustrates a graph of a developed calculation map for determining a charge of a refrigeration system.

FIG. 11 illustrates a graph of charge percentage map 1100 for determining a charge of a refrigeration system. The x1-axis can be the outdoor dry bulb temperature of a test system, such as refrigeration system 100B. The x2-axis can be the indoor wet bulb temperature of a test system. The Y-axis can be a target subcooling temperature. As indicated by key 1102, dots can represent input data used to create third order regression correlations, indicated by lines, between the outdoor dry bulb temperature, indoor wet bulb temperature, and target subcooling temperature.

Map or surface 1104 shown in graph 1100 can represent a unique subcooling surface for a single refrigeration system. A map or surface can be created for each system that is tested according to the methods of FIGS. 8 and/or 9, using the data collected. For example, system sizes can be varied and modeled. In some examples, systems having the same size (capacity) but varying coil sizes or line sizes can be modeled. Maps, such as map 1104, can then be used in the methods described herein to determine a target subcooling for the purposed of determining charge adjustment percentages.

Figure 12:
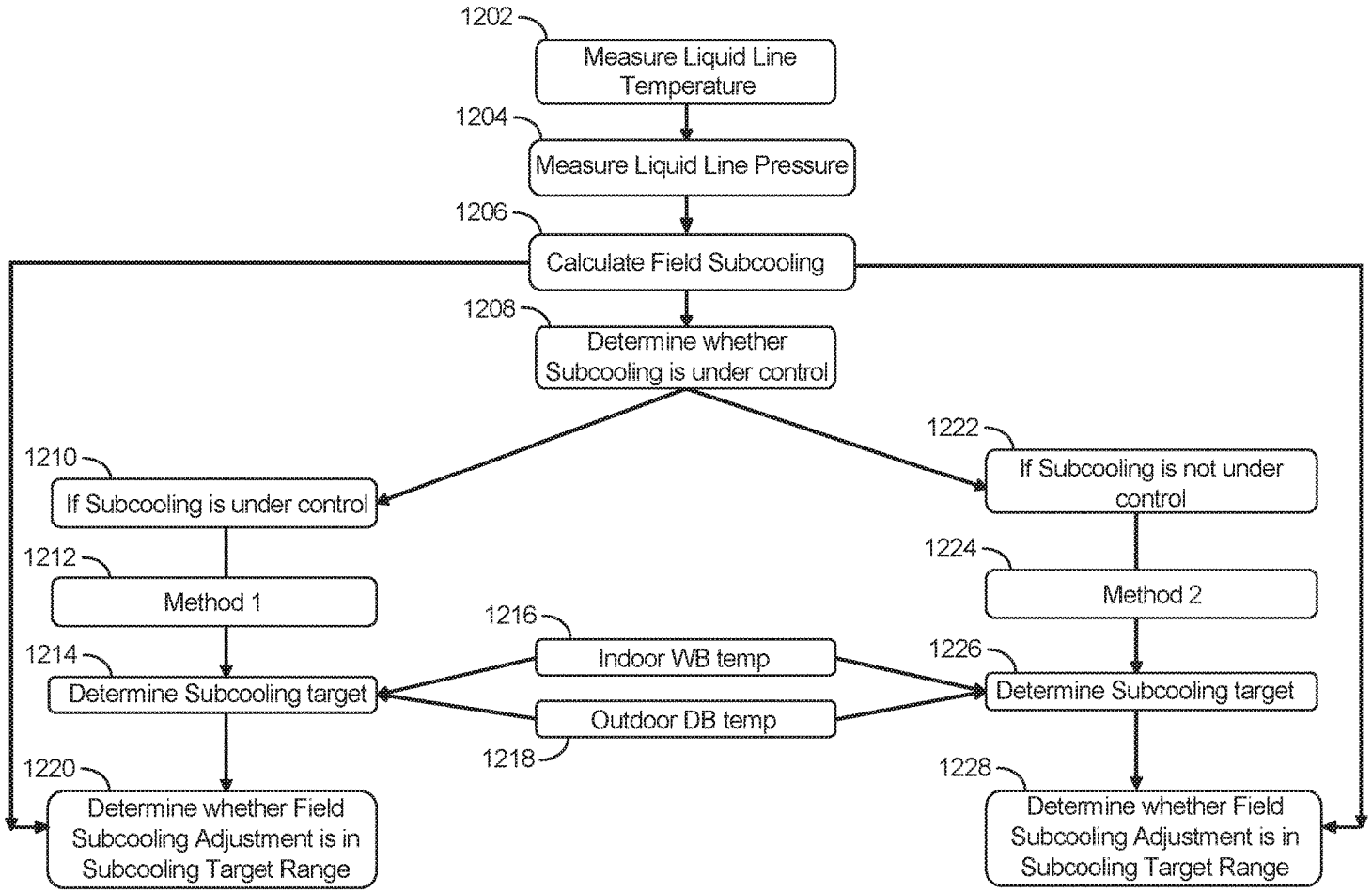
FIG. 12 illustrates a flow diagram of another example method of selecting a method for calculating a charge adjustment for charging the refrigeration system of FIG. 1.

FIG. 12 illustrates a flow diagram of another example method of selecting a method for calculating a charge adjustment for charging the refrigeration system of FIG. 1. The method of FIG. 5 can be used as part of a method for determining a charge adjustment for a field refrigeration system having a TXV or EEV, such as refrigeration systems 100B and 100C, respectfully, as determined by step 202 of FIG. 2.

At step 1202, a field liquid line temperature can be measured, for example, using liquid temperature sensor 136 of refrigeration system 100B. As part of step 1202, liquid temperature sensor 136 can send the field liquid line temperature measurement to controller 104. At step 1204, a field liquid line pressure can be measured, for example, using liquid pressure sensor 134 of refrigeration system 100B. As part of step 1204, liquid pressure sensor 134 can send the field liquid line pressure measurement to controller 104. At step 1206, the field subcooling can be calculated. In one example, controller 104 can calculate the field subcooling based on received values of liquid line pressure and liquid temperatures from liquid pressure sensor 134 and liquid temperature sensor 136, respectfully.

At step 1208, it can be determined whether or not the TXV or EEV is under control, as described in FIG. 2 above, as a function of the field subcooling calculated in step 1206. In some examples, the field subcooling can be compared to a control subcooling value, such as 5° Fahrenheit (2.8° Celsius). In these examples, when the field subcooling is above the control subcooling value, for example 10° Fahrenheit (5.6° Celsius), the subcooling can be determined to be under control, and when the subcooling is below the control subcooling value, for example 1° Fahrenheit (0.6° Celsius), the subcooling can be determined to be not under control.

When it is determined the subcooling is under control at step 1210, a first method can be performed in step 1212, which is further described below in FIG. 12. The target subcooling can be determined, at step 1214, as a function of the field system indoor wet bulb temperature from step 1216 and the field outdoor dry bulb temperature from step 1218. In reference to refrigeration systems 100B and 100C, the indoor wet bulb temperature can be measured by temperature sensors in indoor air zone 108 and can be transmitted to controller 104 for storage. Similarly, the outdoor dry bulb temperatures can be measured by temperature sensors in outdoor air zone 110 and can be transmitted to controller 104 for storage.

At step 1214, the subcooling target can be determined using the subcooling target map from step 808 of FIG. 8. More specifically, the indoor wet bulb temperature of the field system and the outdoor dry bulb temperature of the field system can be used as independent variables to determine a target subcooling temperature using the target subcooling map of step 808.

At step 1220, it can be determined whether a field subcooling adjustment is in the target subcooling range using the field subcooling and the converted target subcooling. In some examples, controller 104 can subtract the target subcooling (St) from the field subcooling (Sf), as given by the equation:

$$\text{Subcooling adjustment} = |Sf - St| \qquad \text{Equation 5}$$

Then, the subcooling adjustment can be compared, for example by controller 104, to a subcooling range value. For example, the field subcooling can be 5° Fahrenheit (2.3° Celsius), the target subcooling can be 10° Fahrenheit (5.6° Celsius), and the range value can be 2° Fahrenheit (1° Celsius). In this example, the subcooling adjustment is 5° Fahrenheit (2.3° Celsius), which is greater than the range value of 2° Fahrenheit (1° Celsius). As a result, it can be determined that the field subcooling adjustment is out of the target subcooling range. In another example, the field subcooling can be 11° Fahrenheit (6.1° Celsius), making the subcooling adjustment 1° Fahrenheit (0.5° Celsius), which is in the target subcooling range. Whether or not the field subcooling adjustment is within the target subcooling range can be used in further methods, as discussed below.

When it is determined the subcooling is not under control at step 1222, a second method can be performed in step 1224, which is further described below in FIG. 13.

The target subcooling can be determined, at step 1224, as a function of the field system indoor wet bulb temperature from step 1216 and the field outdoor dry bulb temperature from step 1218. At step 1224, the subcooling target can be determined using the subcooling target map from step 908 of FIG. 9. More specifically, the indoor wet bulb temperature of the field system and the outdoor dry bulb temperature of the field system can be used as independent variables to determine a target subcooling temperature using the target subcooling map of step 908.

At step 1228, it can be determined whether the field subcooling adjustment is in the target subcooling range using the field subcooling and the converted target subcooling. Step 1228 can use the same procedure as described with respect to step 1220 and equation 5 above to determine whether the field subcooling adjustment is within the target subcooling range. Whether or not the field subcooling adjustment is within the target subcooling range can be used in further methods, as discussed below.

Figure 13:
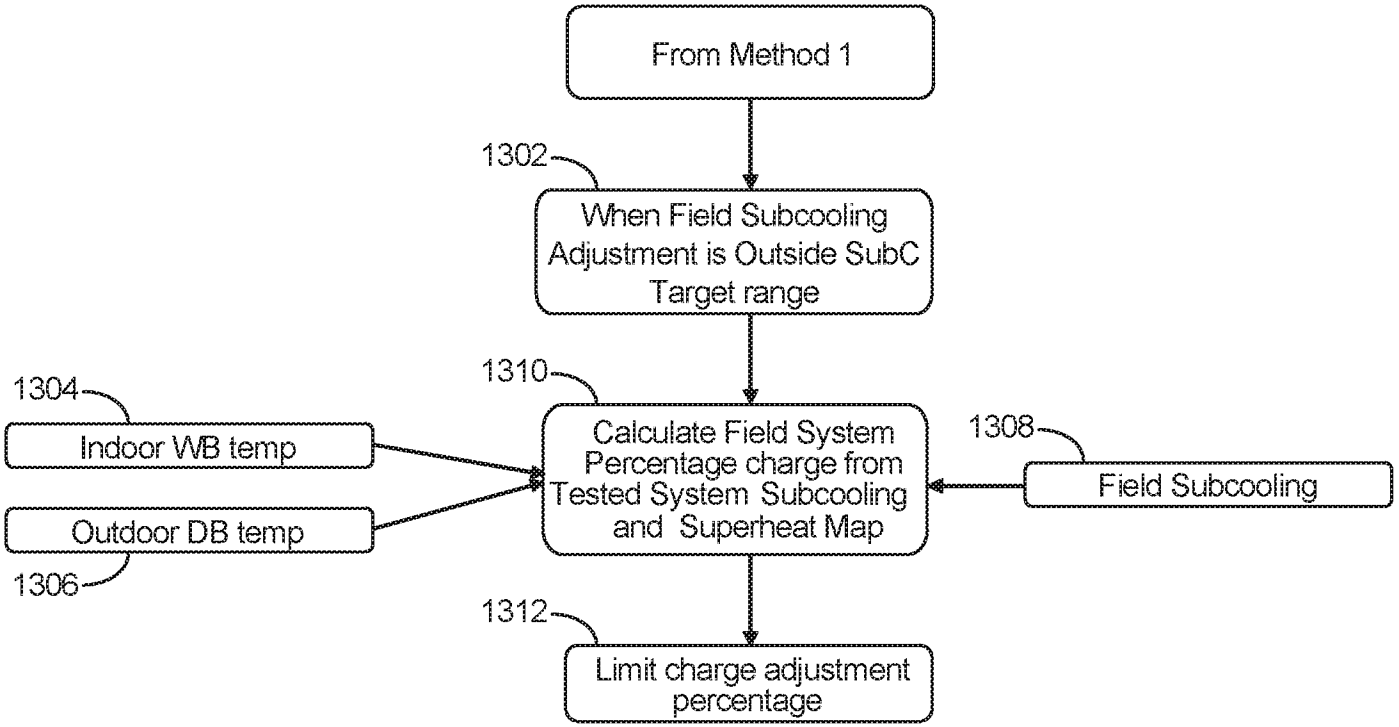
FIG. 13 illustrates a flow diagram of an alternative example method of calculating a charge adjustment for charging the refrigeration system of FIG. 1.

FIG. 13 illustrates a flow diagram of a first method of calculating a charge adjustment, continued from FIG. 12. When the TXV or EEV is under control, a first method, or method 1, can be used to determine a charge adjustment percentage. At step 1302, it can be determined that the field subcooling adjustment is outside the target range, as determined by step 1220 of FIG. 12.

At step 1304, the measured field indoor wet bulb temperature can be measured and communicated to controller 104, or the most recent value can be retrieved by controller 104, such as the value determined in step 1216 of FIG. 12. At step 1306, the measured field outdoor dry bulb temperature can be measured and communicated to controller 104, or the most recent value can be retrieved by controller 104, such as the value determined in step 1218 of FIG. 12. At step 1308, the field subcooling can be determined as a function of the measured liquid line temperature from step 1202 of FIG. 12 and as a function of the measured liquid line pressure from step 1204 of FIG. 12. In some examples, controller 104 can import the field subcooling value from step 1206 at step 1308.

At step 1310, the field system percentage charge can be calculated using charge percentage map created in step 914 of FIG. 9. The charge percentage map can be designed to determine the field system percentage charge as a function of the field subcooling from step 1308, the indoor wet bulb temperature of the field system from step 1304, and the outdoor dry bulb temperature of the field system from step 1306. In operation of one example, controller 104 can be used to perform step 1310, where controller 104 can retrieve the inputs for step 1310 from other steps.

In some embodiments, the charge percentage map can be created so that the field system percentage charge can be determined using fewer conditions of the field system, such as only using field subcooling and the indoor wet bulb temperature of the field system. In some embodiments, the charge percentage map can be created so that the field system percentage charge can be determined as a function of more conditions, such as field superheat.

At step 1312, the charge adjustment percentage can be limited and the charge adjustment weight can be calculated, in accordance with the method of FIG. 7, discussed above.

Figure 14:
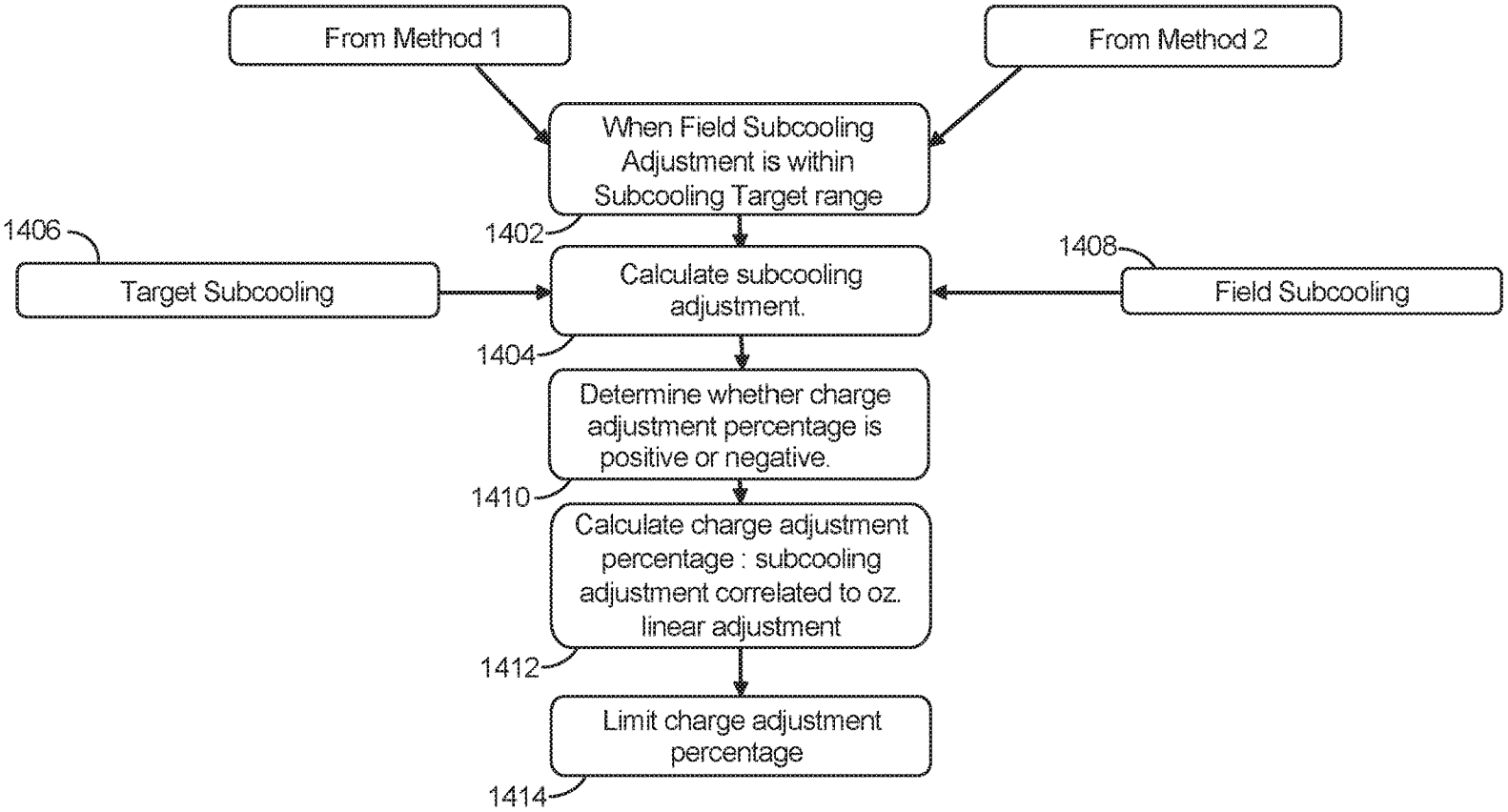
FIG. 14 illustrates a flow diagram of an alternative example method of calculating a charge adjustment for charging the refrigeration system of FIG. 1.

FIG. 14 illustrates a flow diagram of an alternative example method of calculating a charge adjustment for charging the refrigeration system of FIG. 1.

The method of FIG. 14 can begin at step 1402, when it has been determined that the field subcooling adjustment is within the subcooling target range, for example in either step 1220 or step 1228 of FIG. 12. The method of FIG. 14 can be used for either method 1 or method 2 described in FIG. 12.

At step 1404, a subcooling adjustment can be calculated as a function of the target subcooling from step 1406 and the field subcooling from step 1408. The target subcooling of step 1406 can be obtained from either step 1214 or 1226 of FIG. 12. Similarly, the field subcooling can be obtained from step 1206 of FIG. 12.

At step 1410, the subcooling adjustment can be used to determine whether the adjustment is positive or negative. At step 1412, the charge adjustment percentage can be determined as a function of the subcooling adjustment. The determination in step 1412 can be a simple linear correlation between the subcooling adjustment and the charge adjustment percentage to be made. In some examples, a first equation can be used to determine the charge adjustment percentage when the adjustment is determined to be positive at step 1410 and a second equation can be used determine the charge adjustment percentage when the adjustment is determined to be negative at step 1410. In other examples, the same equation can be used to determine the charge adjustment percentage, regardless of whether the charge adjustment is positive or negative. That is, step 1410 can be skipped.

At step 1414, the charge adjustment percentage can be limited and the charge adjustment weight can be calculated in accordance with the method of FIG. 7.

Figure 15:
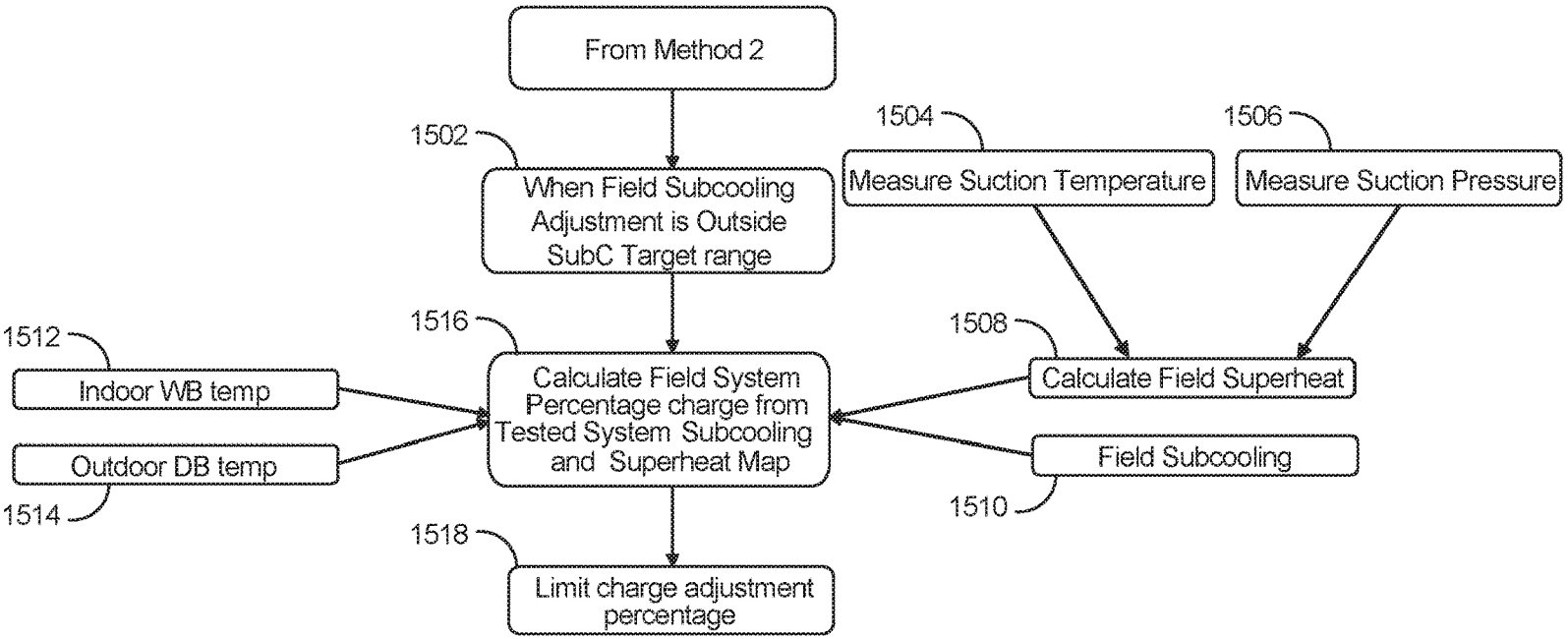
FIG. 15 illustrates a flow diagram of an alternative example method of calculating a charge adjustment for charging the refrigeration system of FIG. 1.

FIG. 15 illustrates a flow diagram of an alternative example method of calculating a charge adjustment for charging the refrigeration system of FIG. 1.

When the TXV or EEV is not under control, a second method, or method 2, can be used to determine a charge adjustment percentage. At step 1502, it can be determined that the field subcooling adjustment is outside the target range, as determined by step 1228 of FIG. 12.

At step 1504 the field suction temperature can be measured, for example by suction temperature sensor 132. At step 1506 the field suction pressure can be measured, for example by suction pressure sensor 130. As part of steps 1504 and 1506, the field suction temperature and pressure measurements can be sent to controller 104 by suction temperature sensor 132 and suction pressure sensor 130, respectively. After receiving the measured field suction temperature and measured field suction pressure, controller 104 can perform step 1508, where field superheat can be calculated as a function of the measured field suction temperature and measured field suction pressure.

Field subcooling can be determined at step 1510, or the field subcooling can be obtained in step 1510 from step 1206 of FIG. 12. At step 1512, the measured field indoor wet bulb temperature can be measured and communicated to controller 104, or the most recent value can be retrieved by controller 104, such as the value determined in step 1216 of FIG. 12. At step 1514, the measured field outdoor dry bulb temperature can be measured and communicated to controller 104, or the most recent value can be retrieved by controller 104, such as the value determined in step 1218 of FIG. 12.

At step 1516, a field system percentage charge can be calculated using charge percentage map created in step 1014 of FIG. 10. The charge percentage map can be designed to determine the field system percentage charge as a function of the field superheat from step 1508, the field subcooling from step 1510, the indoor wet bulb temperature of the field system from step 1512, and the outdoor dry bulb temperature of the field system from step 1514. In operation of one example, controller 104 can be used to perform step 1516, where controller 104 can retrieve the inputs for step 1516 from other steps.

In some embodiments, the charge percentage map can be created so that the field system percentage charge can be determined using fewer conditions of the field system, such as only using field subcooling and the indoor wet bulb temperature of the field system. In some embodiments, the charge percentage map can be created so that the field system percentage charge can be determined as a function of more conditions.

At step 1518, the charge adjustment percentage can be limited and the charge adjustment weight can be calculated, in accordance with the method of FIG. 7, discussed above.

Figure 16:
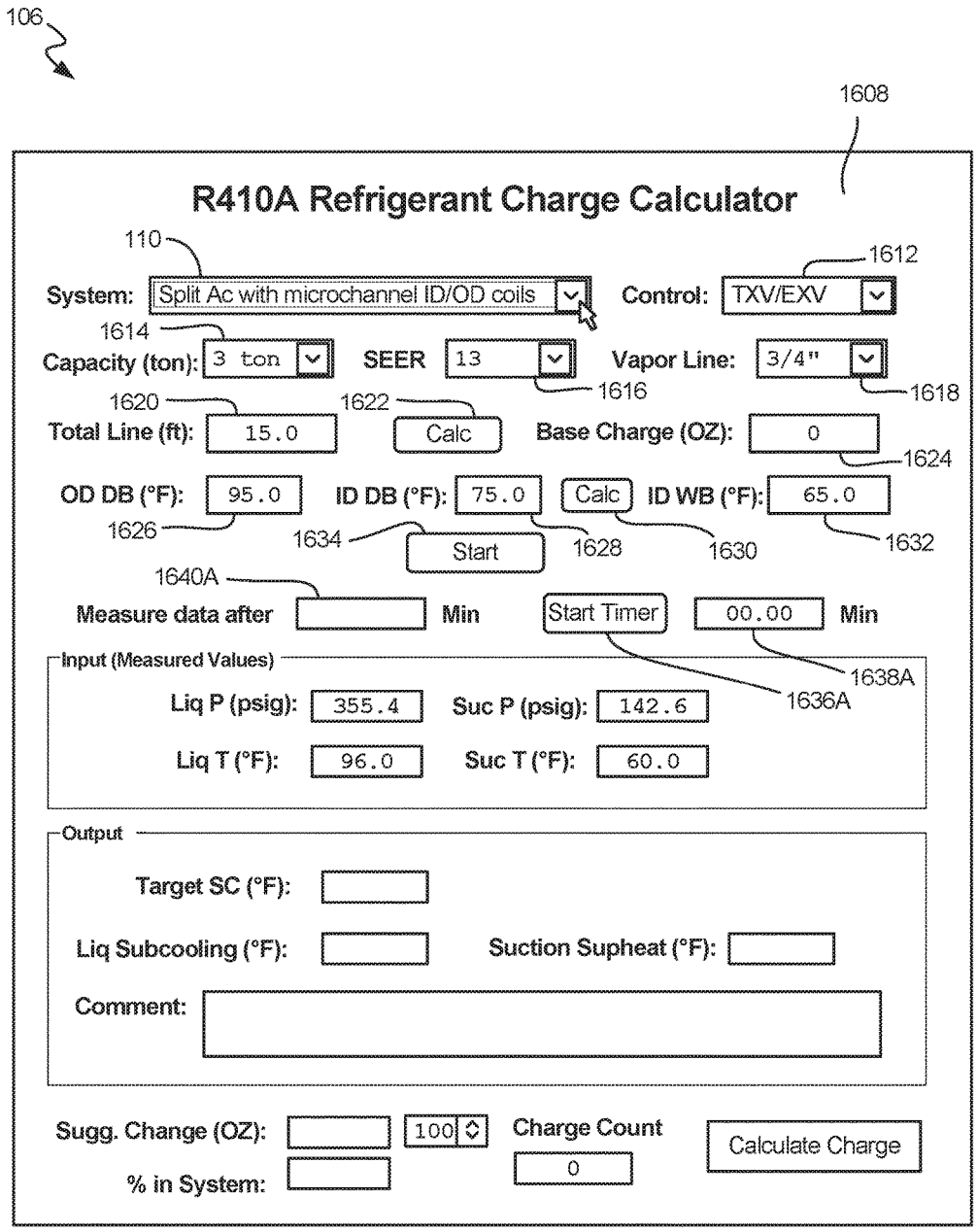
FIG. 16 illustrates a user interface for a program for calculating a charge adjustment for charging the refrigeration system of FIG. 1.

FIG. 16 illustrates user interface 106 for a program for calculating a charge adjustment for charging the refrigeration system of FIG. 1. User interface 106 can include screen 1608, which can include system input box 1610, control input box 1612, capacity input box 1614, efficiency input box 1616, vapor line size input box 1618, total line size input box 1620, calculate button 1622, base charge box 1624, outdoor dry bulb input box 1626, indoor dry bulb input box 1628, second calculate button 1630, indoor wet bulb input box 1632, start button 1634, start timer button 1636A, timer output box 1638A, and time limitation output box 1640A.

Screen 1608 can be used to operate a program that includes one or more of the methods described in FIGS. 2-15 for any of the refrigeration systems described in FIGS. 1A, 1B, and 1C. A user can interface with screen 1608 to enter inputs into the input boxes, such as system input box 1610. The user can also use buttons, such as calculate button 1622, to run operations, such as the methods described above, on controller 104. The user can also receive output from screen 1608 through output boxes, such as timer output box 1638A.

Figure 17:
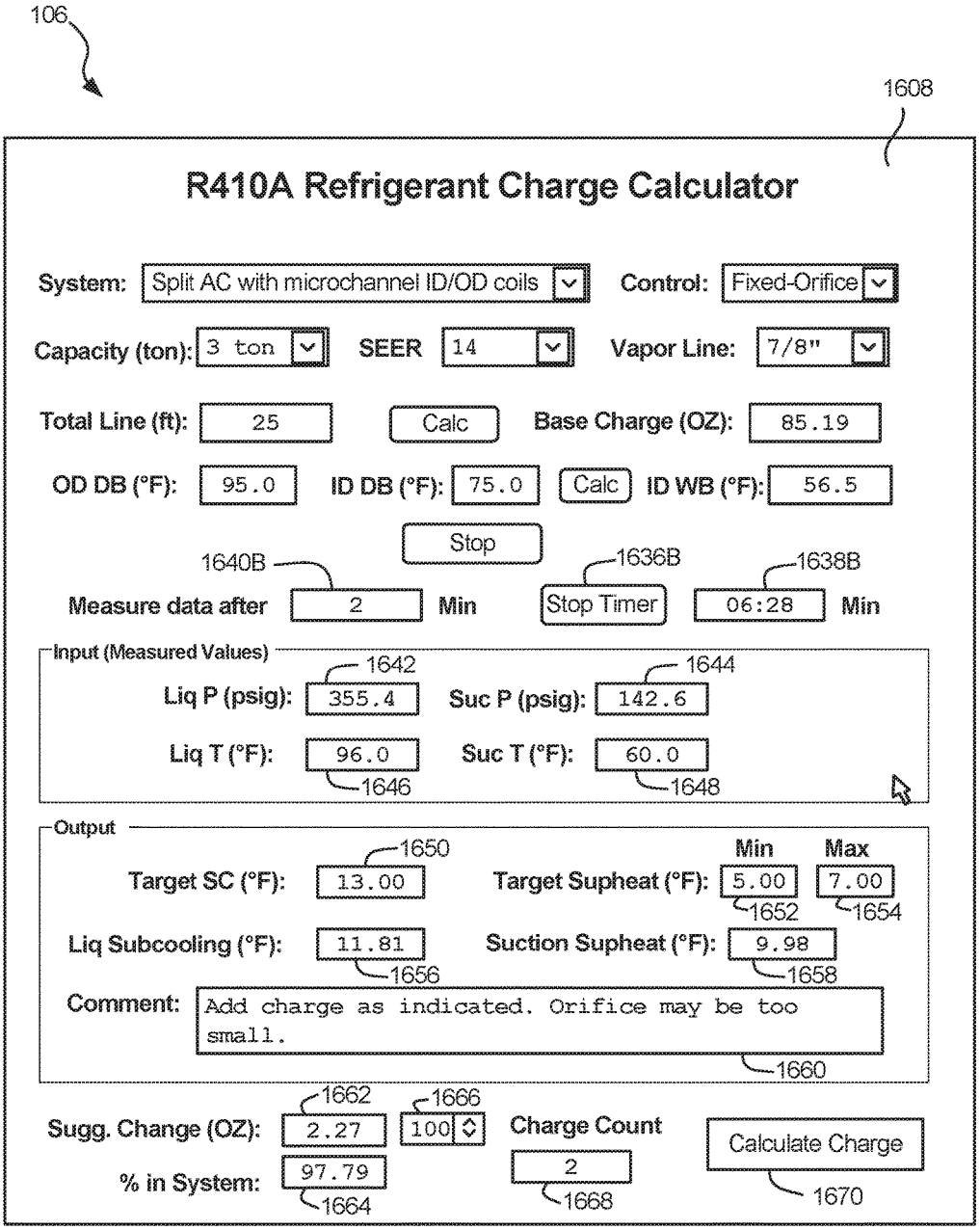
FIG. 17 illustrates a user interface for a program for calculating a charge adjustment for charging the refrigeration system of FIG. 1.

FIG. 17 illustrates user interface 106 for a program for calculating a charge adjustment for charging the refrigeration system of FIG. 1. User interface 106 can include screen 1608, which can include stop timer button 1636B, timer output box 1638B, time limitation output box 1640B, liquid pressure input box 1642, suction pressure input box 1644, liquid temperature input box 1646, suction temperature input box 1648, target subcooling output box 1650, target superheat minimum output box 1652, target superheat maximum output box 1654, liquid subcooling output box 1656, suction superheat output box 1658, comment output box 1660, suggested charge adjustment output box 1662, charge volume percentage output box 1664, charge volume adjuster input box 1666, charge count box 1668, and calculate charge button 1670. FIG. 17 can operate consistently with FIG. 16.

Figure 18:
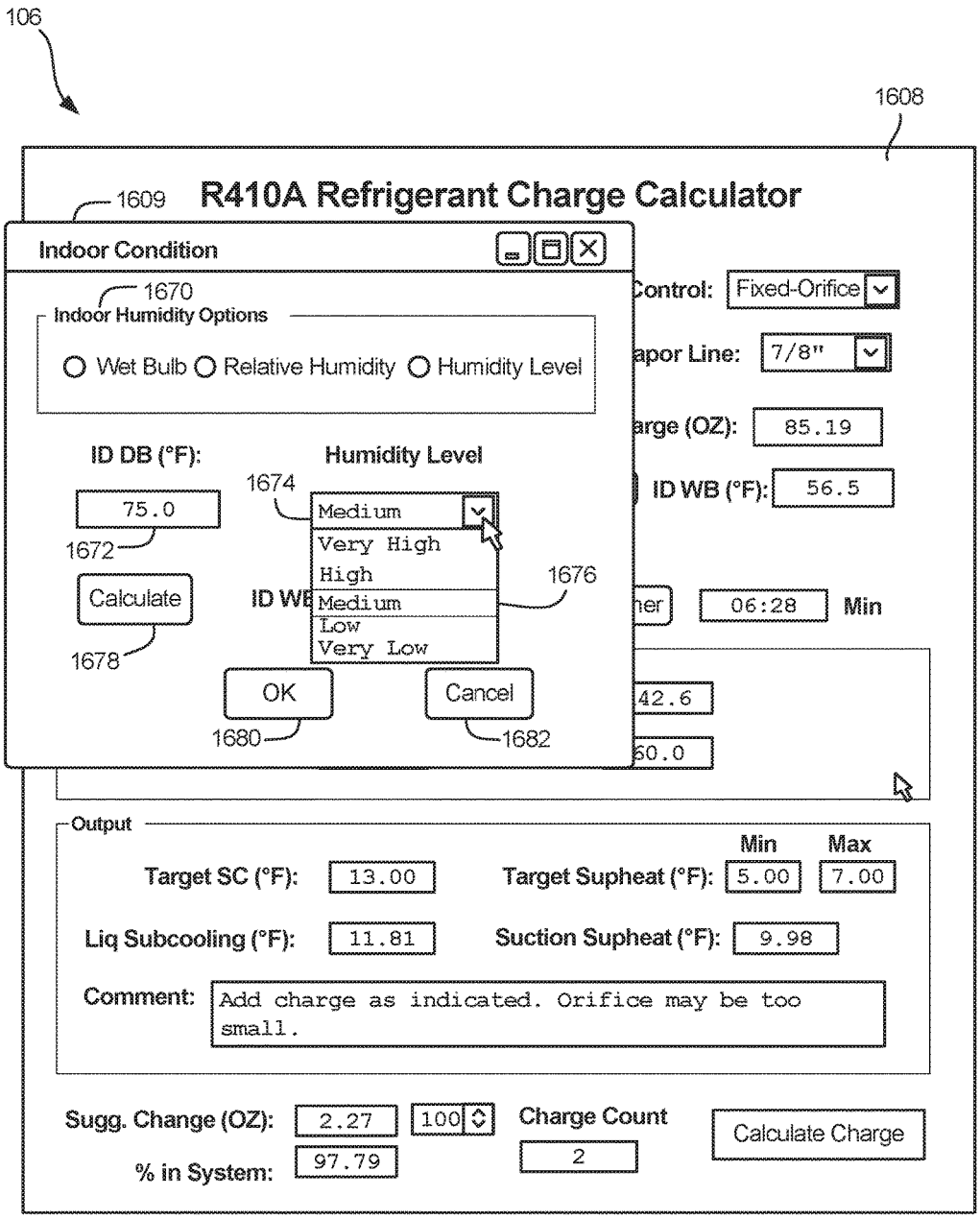
FIG. 18 illustrates a user interface for a program for calculating a charge adjustment for charging the refrigeration system of FIG. 1.

FIG. 18 illustrates user interface 106 for a program for calculating a charge adjustment for charging the refrigeration system of FIG. 1. User interface 106 can include screen 1608 and pop-out screen 1609, which can include indoor humidity options 1670, indoor dry bulb input box 1672, humidity level inbox 1674, third calculate button 1678, ok button 1680, and cancel button 1682. FIG. 18 can operate consistently with FIGS. 16 and 17.

VARIOUS NOTES AND EXAMPLES

Example 1 is a method for charging a field refrigeration system including an evaporator, a condenser, a compressor, and an expansion device, the method comprising: calculating a field subcooling of the field refrigeration system as a function of a measured field liquid line pressure and a measured field liquid line temperature; calculating a charge adjustment percentage as a function of the field subcooling, a measured field indoor wet bulb temperature, and a measured field outdoor dry bulb temperature, determining a refrigerant adjustment weight based on the charge adjustment percentage; and adjusting a field refrigeration system charge by the refrigerant adjustment weight.

In Example 2, the subject matter of Example 1 optionally includes determining whether the expansion device is under control as a function of the field subcooling; performing a first calculation to determine the charge adjustment percentage when the expansion device is under control; and performing a second calculation to determine the charge adjustment percentage when the expansion device is not under control.

In Example 3, the subject matter of any one or more of Examples 1-2 optionally include determining whether the expansion device is under control as a function of the field subcooling; calculating the charge adjustment percentage as a function of the field subcooling, the field indoor wet bulb temperature, and the measured field outdoor dry bulb temperature when the expansion device is under control.

In Example 4, the subject matter of any one or more of Examples 1-3 optionally include determining whether the expansion device is under control as a function of the field subcooling; calculating a field superheat of the field refrigeration system as a function of a measured field suction pressure and a measured field suction temperature; and calculating the charge adjustment percentage as a function of the field subcooling, the field superheat, the measured field indoor wet bulb temperature, and the measured field outdoor dry bulb temperature when the expansion device is not under control.

In Example 5, the subject matter of any one or more of Examples 1-4 optionally include calculating a subcooling target as a function of the measured field indoor wet bulb temperature and the measured field outdoor dry bulb temperature; and determining whether a field subcooling adjustment is within a target subcooling range by comparing the field subcooling to the target subcooling.

In Example 6, the subject matter of Example 5 optionally includes wherein the charge adjustment percentage is calculated based on a linear correlation with the subcooling adjustment when the field subcooling adjustment is within a target subcooling range.

In Example 7, the subject matter of any one or more of Examples 5-6 optionally include calculating a subcooling adjustment as a function of the target subcooling and the field subcooling; determining whether the charge adjustment percentage is a positive charge adjustment percentage or a negative charge adjustment percentage as a function of the field subcooling and the target subcooling; calculating the charge adjustment percentage using a first equation when the charge adjustment percentage is positive; and calculating the charge adjustment percentage using a second equation when the charge adjustment percentage is negative.

In Example 8, the subject matter of Example 7 optionally includes determining whether the expansion device is under control as a function of the field subcooling; calculating the charge adjustment percentage as a function of the field subcooling, the measured field indoor wet bulb temperature, and the measured field outdoor dry bulb temperature when the field subcooling adjustment is outside the target subcooling range and when the expansion device is under control; and calculating the charge adjustment percentage as a function of the field subcooling, the field superheat, the measured field indoor wet bulb temperature, and the measured field outdoor dry bulb temperature when the field subcooling adjustment is outside the target subcooling range and when the expansion device is not under control.

In Example 9, the subject matter of any one or more of Examples 1-8 optionally include determining time to be waited between charge adjustments as a function of the refrigerant adjustment weight.

In Example 10, the subject matter of any one or more of Examples 1-9 optionally include charging a test system at a test full charge condition; operating the test system at a plurality of test outdoor dry bulb temperatures and a plurality of test indoor wet bulb temperatures; collecting subcooling data at the plurality of test outdoor dry bulb temperatures and the plurality of test indoor wet bulb temperatures; creating a target subcooling map as a function of the subcooling data, the test outdoor dry bulb, and the test indoor wet bulb temperatures; and calculating the target subcooling using the target subcooling map.

In Example 11, the subject matter of Example 10 optionally includes charging a test system to a plurality of test charge conditions; operating the test system at a plurality of test outdoor dry bulb temperatures and a plurality of test indoor wet bulb temperatures for each of the plurality of test charge conditions; collecting test subcooling data at each of the plurality of test outdoor dry bulb temperatures and the plurality of test indoor wet bulb temperatures for each of the plurality of the test charge conditions; creating a charge percentage map as a function of the test subcooling data, the test outdoor dry bulb temperatures, and the test indoor wet bulb temperatures; determining whether the expansion device is under control as a function of the field subcooling; and calculating the charge adjustment percentage using the charge adjustment percentage map when the expansion device is under control.

In Example 12, the subject matter of any one or more of Examples 1-11 optionally include charging a test system at a test full charge condition; operating the test system at a plurality of test outdoor dry bulb temperatures and a plurality of test indoor wet bulb temperatures; collecting subcooling data at the plurality of test outdoor dry bulb temperatures and the plurality of test indoor wet bulb temperatures; creating a target subcooling map as a function of the subcooling data, the test outdoor dry bulb, and the test indoor wet bulb temperatures; and calculating the target subcooling using the target subcooling map.

In Example 13, the subject matter of Example 12 optionally includes charging a test system to a plurality of test charge conditions; operating the test system at a plurality of test outdoor dry bulb temperatures and a plurality of test indoor wet bulb temperatures for each of the plurality of test charge conditions; collecting test subcooling data and test superheat data at each of the plurality of test outdoor dry bulb temperatures and the plurality of test indoor wet bulb temperatures for each of the plurality of the test charge conditions; creating a charge percentage map as a function of the test subcooling data, the test superheat data, the test outdoor dry bulb temperatures, and the test indoor wet bulb temperatures; determining whether the expansion device is under control as a function of the field subcooling; and calculating the charge adjustment percentage using the charge adjustment percentage map when the expansion device is not under control.

In Example 14, the subject matter of any one or more of Examples 1-13 optionally include determining a base charge as a function of a capacity of the field refrigeration system and a line size of the field refrigeration system; and determining the refrigerant adjustment charge as a function of the charge adjustment percentage and the base charge.

In Example 15, the subject matter of any one or more of Examples 1-14 optionally include limiting the charge adjustment percentage as a function of a total amount of refrigerant added to the field refrigeration system.

In Example 16, the subject matter of any one or more of Examples 1-15 optionally include limiting the charge adjustment percentage as a function of a number of charging iterations.

In Example 17, the subject matter of any one or more of Examples 1-16 optionally include wherein the expansion device is one of a thermal expansion device, and an electronic expansion device.

Example 18 is a refrigeration system comprising: a compressor configured to pump refrigerant through the refrigeration system; a condenser configured to exchange heat between outdoor air and the refrigerant; an evaporator configured to exchange heat between indoor air and the refrigerant; an expansion device configured to expand the refrigerant; and a controller configured to: calculate a field subcooling of the refrigeration system as a function of a measured liquid line pressure and a measured liquid line temperature; calculate a charge adjustment percentage as a function of the field subcooling, a measured indoor wet bulb temperature, and a measured field outdoor dry bulb temperature; determining a refrigerant adjustment weight based on the charge adjustment percentage; and adjusting a field refrigeration system charge by the refrigerant adjustment weight.

In Example 19, the subject matter of Example 18 optionally includes a liquid pressure sensor for producing a liquid pressure signal as a function of a liquid pressure of the refrigerant, a liquid temperature sensor for producing a liquid temperature signal as a function of a liquid temperature of the refrigerant.

In Example 20, the subject matter of Example 19 optionally includes wherein the controller is further configured to: calculate the target subcooling using a target subcooling map; and calculate the charge adjustment percentage using the charge adjustment percentage map.

In Example 21, the subject matter of any one or more of Examples 19-20 optionally include wherein the expansion device is one of a thermal expansion valve and an electronic expansion valve.

Each of these non-limiting examples can stand on its own, or can be combined in any permutation or combination with any one or more of the other examples.

The above detailed description includes references to the accompanying drawings, which form a part of the detailed description. The drawings show, by way of illustration, specific embodiments in which the present subject matter can be practiced. These embodiments are also referred to herein as "examples." Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

In the event of inconsistent usages between this document and any documents so incorporated by reference, the usage in this document controls.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In this document, the terms "including" and "in which" are used as the plain-English equivalents of the respective terms "comprising" and "wherein." Also, in the following claims, the terms "including" and "comprising" are open-ended, that is, a system, device, article, composition, formulation, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

Method examples described herein can be machine or computer-implemented at least in part. Some examples can include a computer-readable medium or machine-readable medium encoded with instructions operable to configure an electronic device to perform methods as described in the above examples. An implementation of such methods can include code, such as microcode, assembly language code, a higher-level language code, or the like. Such code can include computer readable instructions for performing various methods. The code may form portions of computer program products. Further, in an example, the code can be tangibly stored on one or more volatile, non-transitory, or non-volatile tangible computer-readable media, such as during execution or at other times. Examples of these tangible computer-readable media can include, but are not limited to, hard disks, removable magnetic disks, removable optical disks (e.g., compact disks and digital video disks), magnetic cassettes, memory cards or sticks, random access memories (RAMs), read only memories (ROMs), and the like.

The above description is intended to be illustrative, and not restrictive. For example, the above-described examples (or one or more aspects thereof) may be used in combination with each other. Other embodiments can be used, such as by one of ordinary skill in the art upon reviewing the above description. The Abstract is provided to comply with 37 C.F.R. § 1.72(b), to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description as examples or embodiments, with each claim standing on its own as a separate embodiment, and it is contemplated that such embodiments can be combined with each other in various combinations or permutations. The scope of the present subject matter should be determined with reference to the appended claims, along with the full scope of equivalents to which such claims are entitled.

The invention claimed is:

1. A method for charging a field refrigeration system including an evaporator, a condenser, a compressor, and an expansion device, the method comprising:

calculating a field subcooling of the field refrigeration system as a function of a measured field liquid line pressure and a measured field liquid line temperature;

calculating a charge adjustment percentage as a function of the field subcooling, a measured field indoor wet bulb temperature, and a measured field outdoor dry bulb temperature;

determining a refrigerant adjustment weight based on the charge adjustment percentage; and adjusting a field refrigeration system charge by the refrigerant adjustment weight.

2. The method of claim 1, further comprising:

determining whether the expansion device is under control as a function of the field subcooling;

performing a first calculation to determine the charge adjustment percentage when the expansion device is under control; and performing a second calculation to determine the charge adjustment percentage when the expansion device is not under control.

3. The method of claim 1, further comprising:

determining whether the expansion device is under control as a function of the field subcooling;

calculating the charge adjustment percentage as a function of the field subcooling, the field indoor wet bulb temperature, and the measured field outdoor dry bulb temperature when the expansion device is under control.

4. The method of claim 1, further comprising:

determining whether the expansion device is under control as a function of the field subcooling;

calculating a field superheat of the field refrigeration system as a function of a measured field suction pressure and a measured field suction temperature; and calculating the charge adjustment percentage as a function of the field subcooling, the field superheat, the measured field indoor wet bulb temperature, and the measured field outdoor dry bulb temperature when the expansion device is not under control.

5. The method of claim 1, further comprising:

calculating a subcooling target as a function of the measured field indoor wet bulb temperature and the measured field outdoor dry bulb temperature; and determining whether a field subcooling adjustment is within a target subcooling range by comparing the field subcooling to the target subcooling.

6. The method of claim 5, wherein the charge adjustment percentage is calculated based on a linear correlation with the subcooling adjustment when the field subcooling adjustment is within a target subcooling range.

7. The method of claim 5, further comprising:

calculating a subcooling adjustment as a function of the target subcooling and the field subcooling;

determining whether the charge adjustment percentage is a positive charge adjustment percentage or a negative charge adjustment percentage as a function of the field subcooling and the target subcooling;

calculating the charge adjustment percentage using a first equation when the charge adjustment percentage is positive; and calculating the charge adjustment percentage using a second equation when the charge adjustment percentage is negative.

8. The method of claim 7, further comprising:

determining whether the expansion device is under control as a function of the field subcooling;

calculating the charge adjustment percentage as a function of the field subcooling, the measured field indoor wet bulb temperature, and the measured field outdoor dry bulb temperature when the field subcooling adjustment is outside the target subcooling range and when the expansion device is under control; and calculating the charge adjustment percentage as a function of the field subcooling, the field superheat, the measured field indoor wet bulb temperature, and the measured field outdoor dry bulb temperature when the field subcooling adjustment is outside the target subcooling range and when the expansion device is not under control.

9. The method of claim 1, further comprising:

determining time to be waited between charge adjustments as a function of the refrigerant adjustment weight.

10. The method of claim 1, further comprising:

charging a test system at a test full charge condition;

operating the test system at a plurality of test outdoor dry bulb temperatures and a plurality of test indoor wet bulb temperatures;

collecting subcooling data at the plurality of test outdoor dry bulb temperatures and the plurality of test indoor wet bulb temperatures;

creating a target subcooling map as a function of the subcooling data, the test outdoor dry bulb, and the test indoor wet bulb temperatures; and calculating the target subcooling using the target subcooling map.

11. The method of claim 10, further comprising:
charging a test system to a plurality of test charge conditions;
operating the test system at a plurality of test outdoor dry bulb temperatures and a plurality of test indoor wet bulb temperatures for each of the plurality of test charge conditions;
collecting test subcooling data at each of the plurality of test outdoor dry bulb temperatures and the plurality of test indoor wet bulb temperatures for each of the plurality of the test charge conditions;
creating a charge percentage map as a function of the test subcooling data, the test outdoor dry bulb temperatures, and the test indoor wet bulb temperatures;
determining whether the expansion device is under control as a function of the field subcooling; and
calculating the charge adjustment percentage using the charge adjustment percentage map when the expansion device is under control.

12. The method of claim 1, further comprising:
charging a test system at a test full charge condition;
operating the test system at a plurality of test outdoor dry bulb temperatures and a plurality of test indoor wet bulb temperatures;
collecting subcooling data at the plurality of test outdoor dry bulb temperatures and the plurality of test indoor wet bulb temperatures;
creating a target subcooling map as a function of the subcooling data, the test outdoor dry bulb, and the test indoor wet bulb temperatures; and
calculating the target subcooling using the target subcooling map.

13. The method of claim 12, further comprising:
charging a test system to a plurality of test charge conditions;
operating the test system at a plurality of test outdoor dry bulb temperatures and a plurality of test indoor wet bulb temperatures for each of the plurality of test charge conditions;
collecting test subcooling data and test superheat data at each of the plurality of test outdoor dry bulb temperatures and the plurality of test indoor wet bulb temperatures for each of the plurality of the test charge conditions;
creating a charge percentage map as a function of the test subcooling data, the test superheat data, the test outdoor dry bulb temperatures, and the test indoor wet bulb temperatures;
determining whether the expansion device is under control as a function of the field subcooling; and
calculating the charge adjustment percentage using the charge adjustment percentage map when the expansion device is not under control.

14. The method of claim 1, further comprising:
determining a base charge as a function of a capacity of the field refrigeration system and a line size of the field refrigeration system; and
determining the refrigerant adjustment charge as a function of the charge adjustment percentage and the base charge.

15. The method of claim 1, further comprising:
limiting the charge adjustment percentage as a function of a total amount of refrigerant added to the field refrigeration system.

16. The method of claim 1, further comprising:
limiting the charge adjustment percentage as a function of a number of charging iterations.

17. The method of claim 1, wherein the expansion device is one of a thermal expansion device, and an electronic expansion device.

18. A method for charging a field refrigeration system including an evaporator, a condenser, a compressor, and an expansion device, the method comprising:
calculating a field subcooling of the field refrigeration system as a function of a measured field liquid line pressure and a measured field liquid line temperature;
calculating a charge adjustment percentage as a function of the field subcooling, a measured field indoor wet bulb temperature, and a measured field outdoor dry bulb temperature;
determining a refrigerant adjustment weight based on the charge adjustment percentage;
adjusting a field refrigeration system charge by the refrigerant adjustment weight;
determining a base charge as a function of a capacity of the field refrigeration system and a line size of the field refrigeration system; and
determining the refrigerant adjustment charge as a function of the charge adjustment percentage and the base charge.

19. A method for charging a field refrigeration system including an evaporator, a condenser, a compressor, and an expansion device, the method comprising:
calculating a field subcooling of the field refrigeration system as a function of a measured field liquid line pressure and a measured field liquid line temperature;
calculating a charge adjustment percentage as a function of the field subcooling, a measured field indoor wet bulb temperature, and a measured field outdoor dry bulb temperature;
determining a refrigerant adjustment weight based on the charge adjustment percentage;
adjusting a field refrigeration system charge by the refrigerant adjustment weight;
calculating a subcooling target as a function of the measured field indoor wet bulb temperature and the measured field outdoor dry bulb temperature; and
determining whether a field subcooling adjustment is within a target subcooling range by comparing the field subcooling to the target subcooling, wherein the charge adjustment percentage is calculated based on a linear correlation with the subcooling adjustment when the field subcooling adjustment is within a target subcooling range.

20. The method of claim 19, further comprising:
charging a test system to a plurality of test charge conditions;
operating the test system at a plurality of test outdoor dry bulb temperatures and a plurality of test indoor wet bulb temperatures for each of the plurality of test charge conditions;
collecting test subcooling data at each of the plurality of test outdoor dry bulb temperatures and the plurality of test indoor wet bulb temperatures for each of the plurality of the test charge conditions;
creating a charge percentage map as a function of the test subcooling data, the test outdoor dry bulb temperatures, and the test indoor wet bulb temperatures;
determining whether the expansion device is under control as a function of the field subcooling; and
calculating the charge adjustment percentage using the charge adjustment percentage map when the expansion device is under control.

* * * * *